US007316118B2

(12) United States Patent
Hirota et al.

(10) Patent No.: US 7,316,118 B2
(45) Date of Patent: Jan. 8, 2008

(54) EXPANSION VALVE

(75) Inventors: Hisatoshi Hirota, Tokyo (JP); Michio Matsumoto, Tokyo (JP)

(73) Assignee: TGK Co., Ltd., Tokyo (JP)

( * ) Notice: Subject to any disclaimer, the term of this patent is extended or adjusted under 35 U.S.C. 154(b) by 461 days.

(21) Appl. No.: 10/890,319

(22) Filed: Jul. 14, 2004

(65) Prior Publication Data

US 2005/0016208 A1 Jan. 27, 2005

(30) Foreign Application Priority Data

Jul. 23, 2003 (JP) ..... 2003-277971

(51) Int. Cl.
*F25B 41/04* (2006.01)
*G05D 27/00* (2006.01)

(52) U.S. Cl. ..... 62/222; 236/92 B

(58) Field of Classification Search ..... 62/222, 62/226, 227; 236/92 B, 92 R; 251/129.15
See application file for complete search history.

(56) References Cited

FOREIGN PATENT DOCUMENTS

| | | |
|---|---|---|
| DE | 299 09 494 | 10/1999 |
| EP | 0 959 310 | 11/1999 |
| EP | 1 130 345 | 9/2001 |
| JP | 2001-183032 | 7/2001 |
| JP | 2001-241808 | 9/2001 |

*Primary Examiner*—Chen Wen Jiang
(74) *Attorney, Agent, or Firm*—Westerman, Hattori, Daniels & Adrian, L.L.P.

(57) ABSTRACT

To provide an expansion valve having a low-pressure passage that is bent at right angles therein, which is reduced in untoward noise and noise of the flow of refrigerant generated when the refrigerant passes through the low-pressure passage. In an intersecting portion of a low-pressure passage, the axis of a port for introducing refrigerant returned from an evaporator, and the axis of a port for guiding out refrigerant having passed through a body block to a compressor are orthogonal to each other. A hole is formed in the body block in a direction of insertion of a shaft that transmits a driving force from a power element to a valve element, and a holder for holding the shaft. When holes coaxial with the ports, respectively, are formed by drills having the same diameter as that of the hole, the holes are formed in a manner such that the tip of one drill does not extend beyond the hole formed by the other drill, to make inner walls on an outer peripheral side along which refrigerant flows at an increased speed, smoothly continuous, without forming any recess or edge portion having a boundary portion with an angle equal to or smaller than a right angle.

10 Claims, 26 Drawing Sheets

EXPANSION VALVE

CROSS-REFERENCES TO RELATED APPLICATIONS, IF ANY

This application claims priority of Japanese Application No. 2003-277971 filed on Jul. 23, 2003 and entitled "EXPANSION VALVE".

BACKGROUND OF THE INVENTION (1.) Field of the Invention

The present invention relates to an expansion valve, and more particularly to an expansion valve that senses the temperature and pressure of refrigerant in an outlet of an evaporator in a refrigeration cycle for an automotive air conditioning system, and controls the amount of refrigerant to be supplied to the evaporator.

(2.) Description of the Related Art

In an automotive air conditioning system, a refrigeration cycle is formed such that high-temperature, high-pressure gaseous refrigerant compressed by a compressor is condensed by a condenser; the condensed refrigerant is caused to undergo gas/liquid separation by a receiver/dryer; liquid refrigerant obtained by the gas/liquid separation is caused to undergo adiabatic expansion by an expansion valve, to be changed into low-temperature, low-pressure refrigerant, which is then evaporated by an evaporator; and the evaporated refrigerant is returned to the compressor. The evaporator to which is supplied the low-pressure refrigerant exchanges heat with the air in the compartment, to thereby cool the same.

The expansion valve comprises a power element that has pressure therein increased and decreased by sensing changes in the temperature and pressure of refrigerant on the outlet side of the evaporator, and a valve portion that controls the amount of refrigerant to be supplied to the inlet side of the evaporator based on the increase and decrease in pressure within the power element.

The power element includes a temperature-sensing chamber partitioned by a diaphragm made of a thin metal plate. When the power element senses changes in the temperature and pressure of refrigerant, the pressure within the temperature-sensing chamber is changed to displace the diaphragm. The displacement of the diaphragm is transmitted to a valve element of the valve portion via a shaft that extends axially, to cause the valve portion to perform opening/closing operation, whereby the flow rate of refrigerant through the valve is controlled. The valve portion has a valve seat formed in a passage extending between a port to which high-pressure refrigerant is introduced and a port from which adiabatically-expanded low-pressure refrigerant is allowed to flow. The valve element is disposed such that it can move to and away from the valve seat on an upstream side where high-pressure refrigerant is received, and the valve element is driven for opening/closing operation by the shaft extending from the power element through the valve hole thereof.

The expansion valve constructed as above is disposed in an engine room, a compartment or a partition dividing them, and in the expansion valve, a pipe leading to the receiver/dryer is connected to the high-pressure inlet port of the valve portion, a pipe leading to the evaporator is connected to the low-pressure outlet port of the same, a pipe from the evaporator is connected to the low-pressure inlet port of the power element, and a pipe extending to the compressor is connected to the low-pressure outlet port of the same. In a general expansion valve, a low-pressure outlet port to which is connected a pipe extending to the compressor is provided in the same side surface where a high-pressure inlet port of a valve portion is formed, and in an opposite side surface to the side surface, there are provided a low-pressure outlet port of the valve portion and a low-pressure inlet port to which is connected a pipe from the evaporator. That is, the low-pressure outlet port though which refrigerant from the expansion valve is guided out is formed along an axis parallel to the axis of the high-pressure inlet port through which refrigerant is introduced to the expansion valve, while the low-pressure inlet and outlet ports for causing refrigerant returned from the evaporator to flow to the compressor are disposed on the same axis. This means that e.g. when the expansion valve and the evaporator are mounted in a narrow mounting space, such as an engine room, the flexibility in layout thereof is sometimes limited. For example, when the direction of a pipe of the expansion valve, connected to the evaporator, and the direction of pipes of the expansion valve, connected to the receiver/dryer and the compressor, are caused to be orthogonal to each other, the pipe connected to the compressor has to be bent halfway, which requires an extra space for bending the pipe.

To avoid this inconvenience, an expansion valve has been proposed which is configured to be capable of having pipes connected to a body block in the form of a prism at right angles (see e.g. Japanese Unexamined Patent Publication (Kokai) No. 2001-241808 (Paragraph No. [0024], and FIGS. 7 and 8)) by forming ports to which are connected the pipes, in two adjacent side surfaces of the body block. This expansion valve is configured such that the axis of the high-pressure inlet port of the valve portion and the axis of the low-pressure outlet port thereof are orthogonal to each other, and the axes of the low-pressure inlet port and the low-pressure outlet port through which refrigerant returned from the evaporator passes are orthogonal to each other. Due to this construction, since the four ports are provided in the two adjacent side surfaces of the body block, it becomes possible to efficiently accommodate the expansion valve within a limited space. Now, a description will be given of the construction of a low-pressure passage through which refrigerant returned from the evaporator passes to flow to the compressor.

FIG. 26 is a cross-sectional view of a low-pressure passage of a conventional expansion valve.

The conventional expansion valve includes a low-pressure inlet port 101 for introducing refrigerant returned from the evaporator and a low-pressure outlet port 102 for a pipe connected to the compressor, on respective two adjacent side surfaces of a body block 100 in the form of a prism, and a low-pressure passage 103 having portions that extend from the low-pressure inlet port 101 and the low-pressure outlet port 102 along their axes and intersect at right angles within the body block 100. The low-pressure passage 103 is formed by making holes with drills such that the respective axes of the holes are orthogonal to each other, and when forming the holes, they are drilled until the tip of one of the drills sufficiently passes through a hole made by the other of the drills, such that the holes formed by the respective drills positively communicate with each other within the body block 100.

As a result, when refrigerant introduced from the evaporator into the low-pressure inlet port 101 flows through the low-pressure passage 103, the direction of flow thereof is changed at right angles, whereafter it flows from the low-pressure outlet port 102 to the compressor. Since the expansion valve itself contains the refrigerant passage bent at right angles, there is no need to bend pipes connected to the expansion valve, thereby making it possible to arrange the piping over the shortest length.

However, when the low-pressure passage 103 is formed by drilling from the two adjacent side surfaces, drilling is continued until the tip of one drill positively passes through a portion of the cylindrical low-pressure passage 103 formed by the other drill in a direction orthogonal to the direction of drilling by the drill, and hence inner walls of the portions of the low-pressure passage 103 on the outer peripheral sides thereof, which are orthogonal to each other, are formed with recesses 104 and edge portions 105 by the tip and its vicinity of each drill. When refrigerant passes the recesses 104 and the edge portions 105 at a faster flow speed than it flows along the inner peripheral side of the low-pressure passage 103, the flow of refrigerant is made turbulent to generate unusual noise, and the turbulent flow of the refrigerant increases noise of the flow of refrigerant.

SUMMARY OF THE INVENTION

The present invention has been made in view of the above points, and an object thereof is to provide an expansion valve that has a low-pressure passage formed therein and bent at right angles, which is reduced in untoward noise and noise of the flow of refrigerant which are generated when the refrigerant passes through the low-pressure passage.

To solve the above problem, the present invention provides an expansion valve that has ports opening in adjacent side surfaces of a prismatic body, the ports communicating with a low-pressure passage that is bent at right angles within the prismatic body, wherein the low-pressure passage is formed by drilling first and second holes in a manner such that when the first and second holes are drilled from the adjacent side surfaces along respective axes of the ports, a tip of one of the drills is stopped in the first or second hole drilled by the other of the drills.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

Hereinafter, embodiments of the present invention will be described in detail with reference to the drawings.

Figure 1:
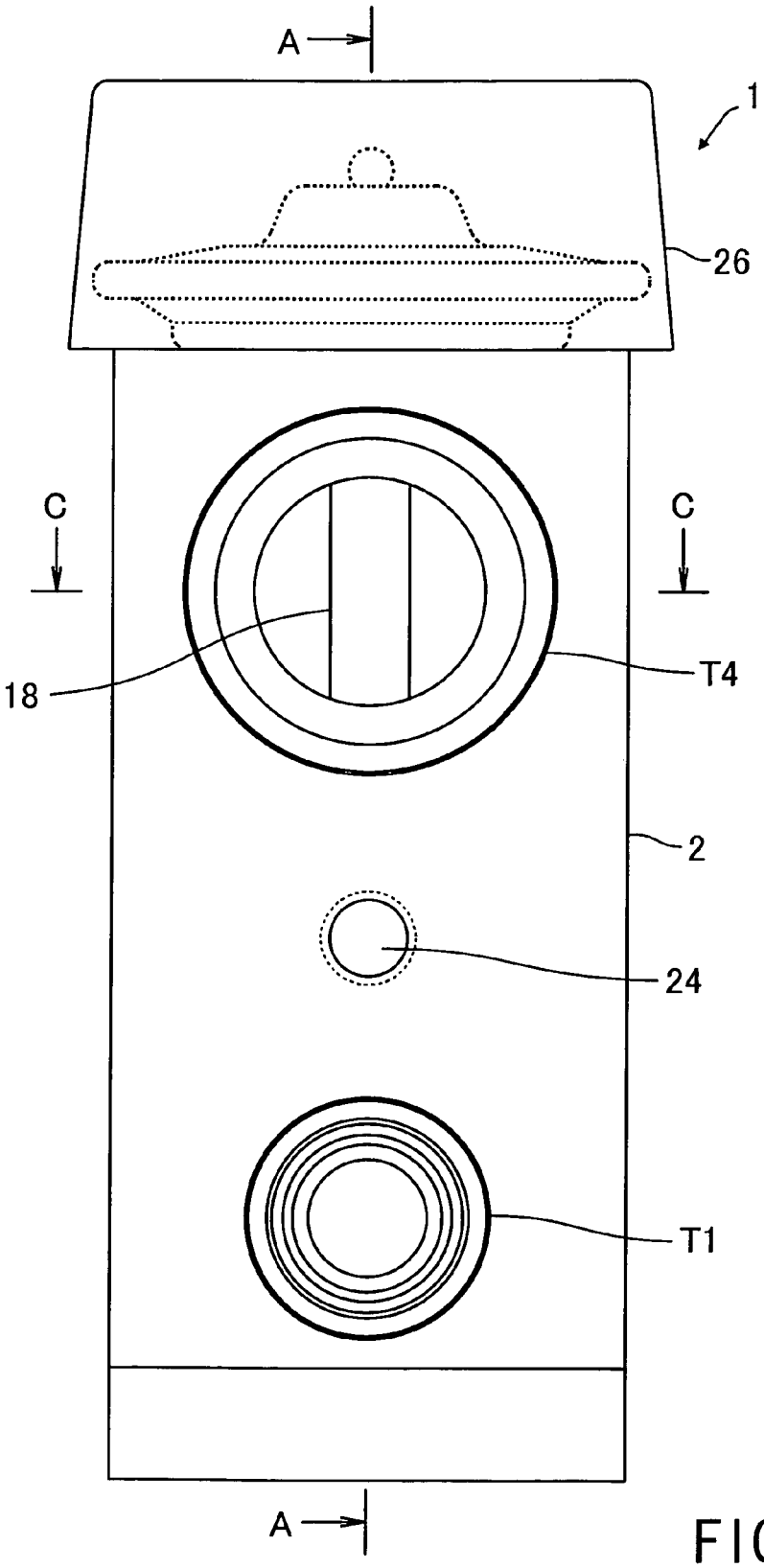
FIG. 1 is a front view showing the appearance of an expansion valve according to a first embodiment of the present invention.
Figure 2:
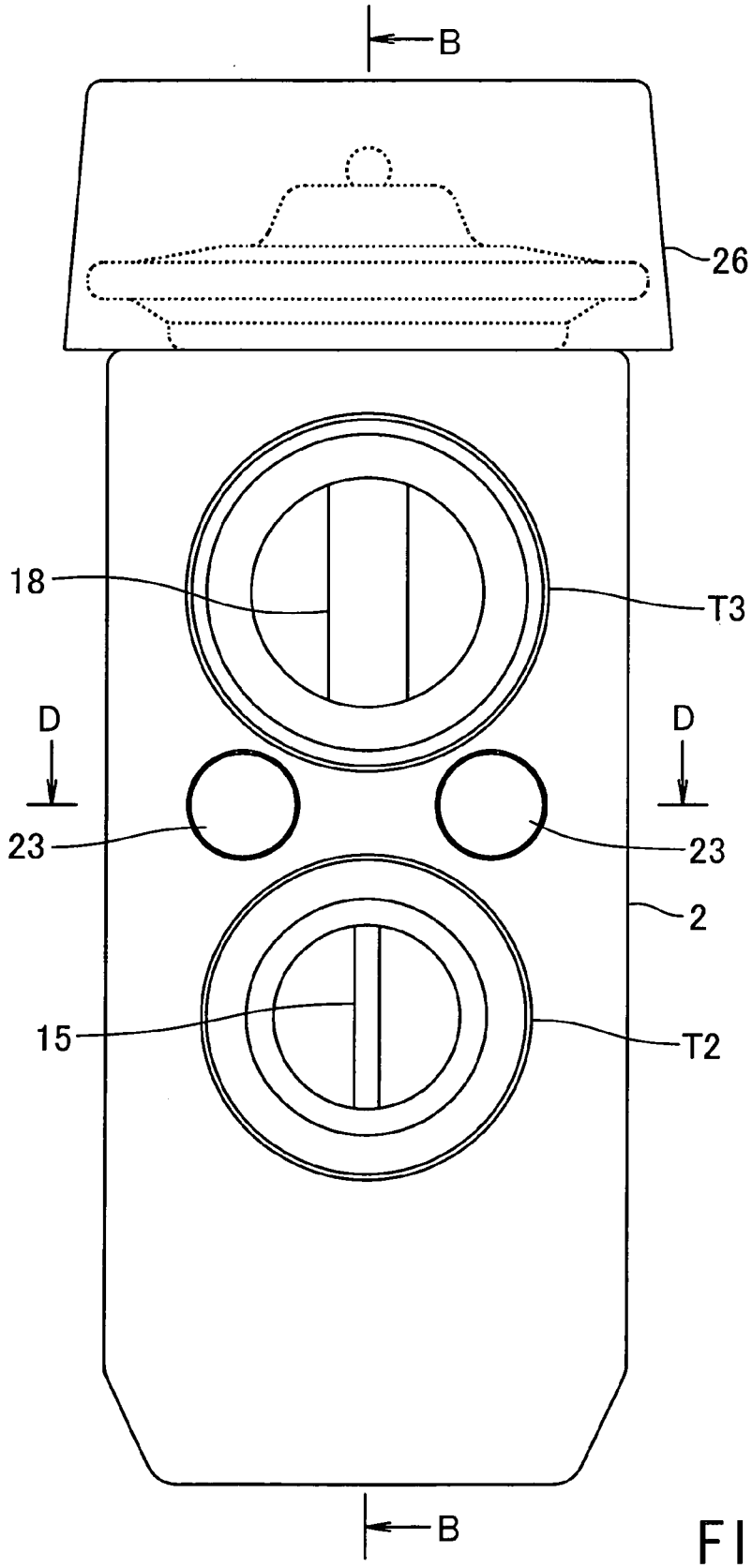
FIG. 2 is a side view showing the appearance of the expansion valve according to the first embodiment.
Figure 3:
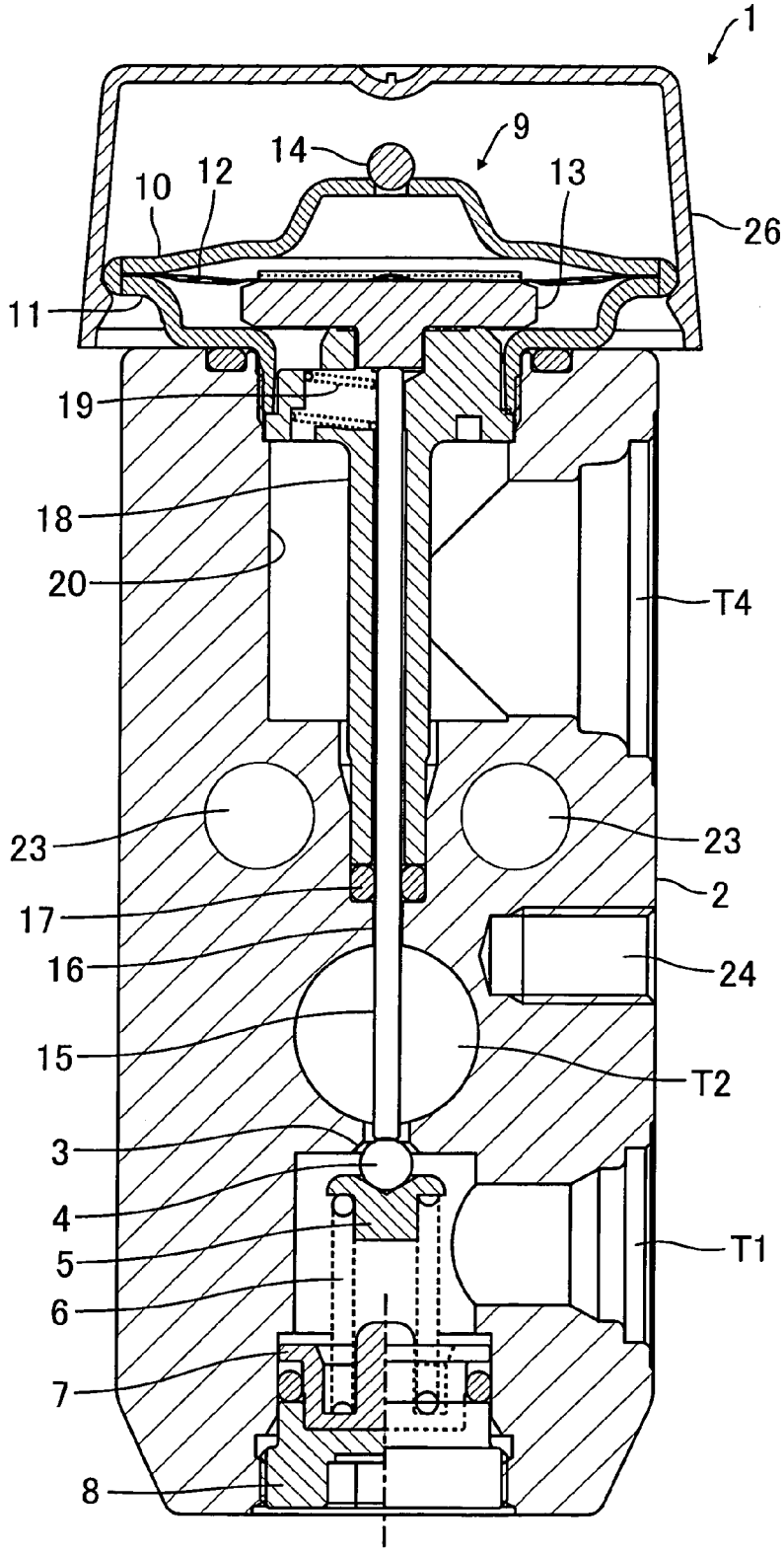
FIG. 3 is a cross-sectional view of the expansion valve taken on line A-A of FIG. 1.
Figure 4:
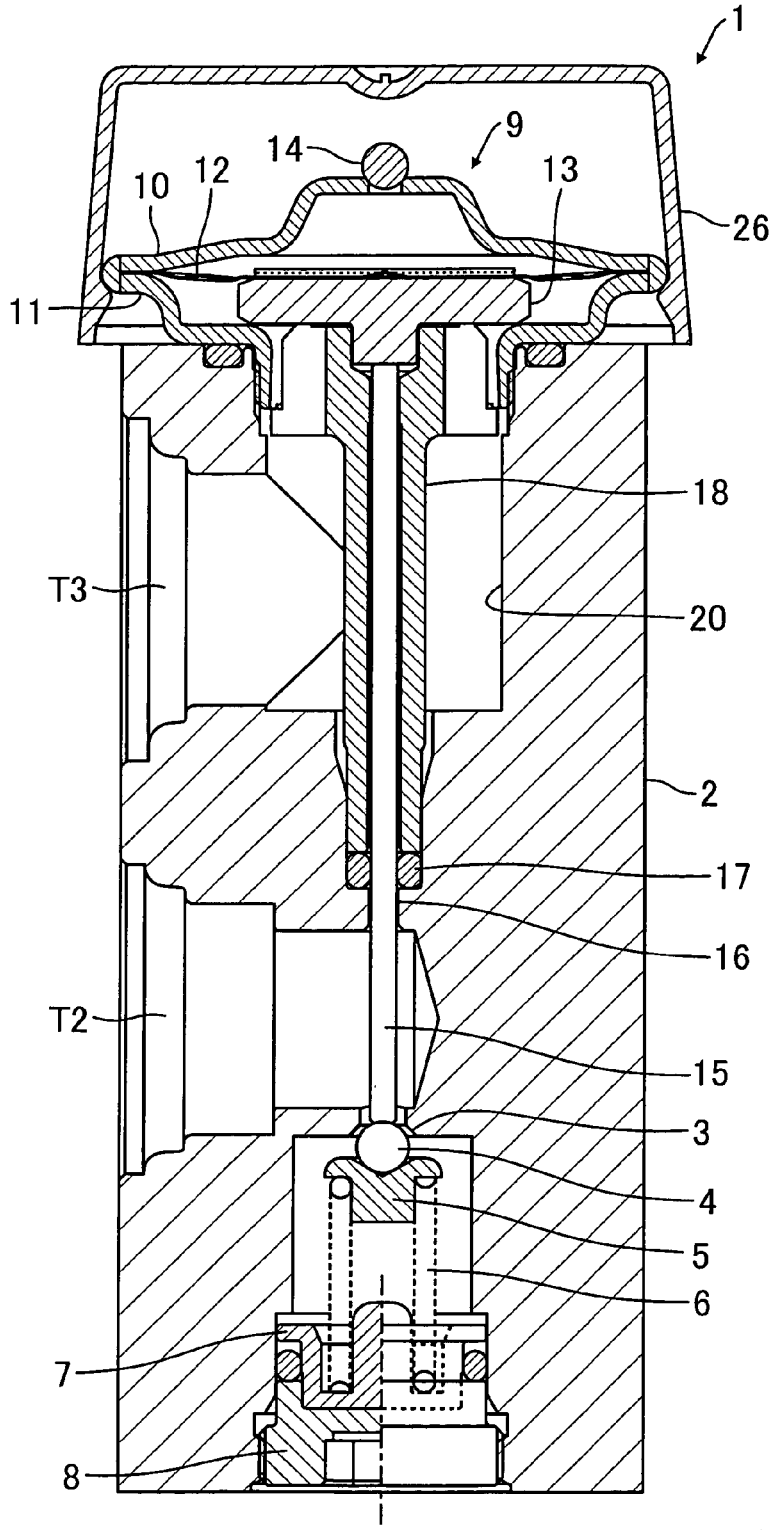
FIG. 4 is a cross-sectional view of the expansion valve taken on line B-B of FIG. 2.
Figure 5:
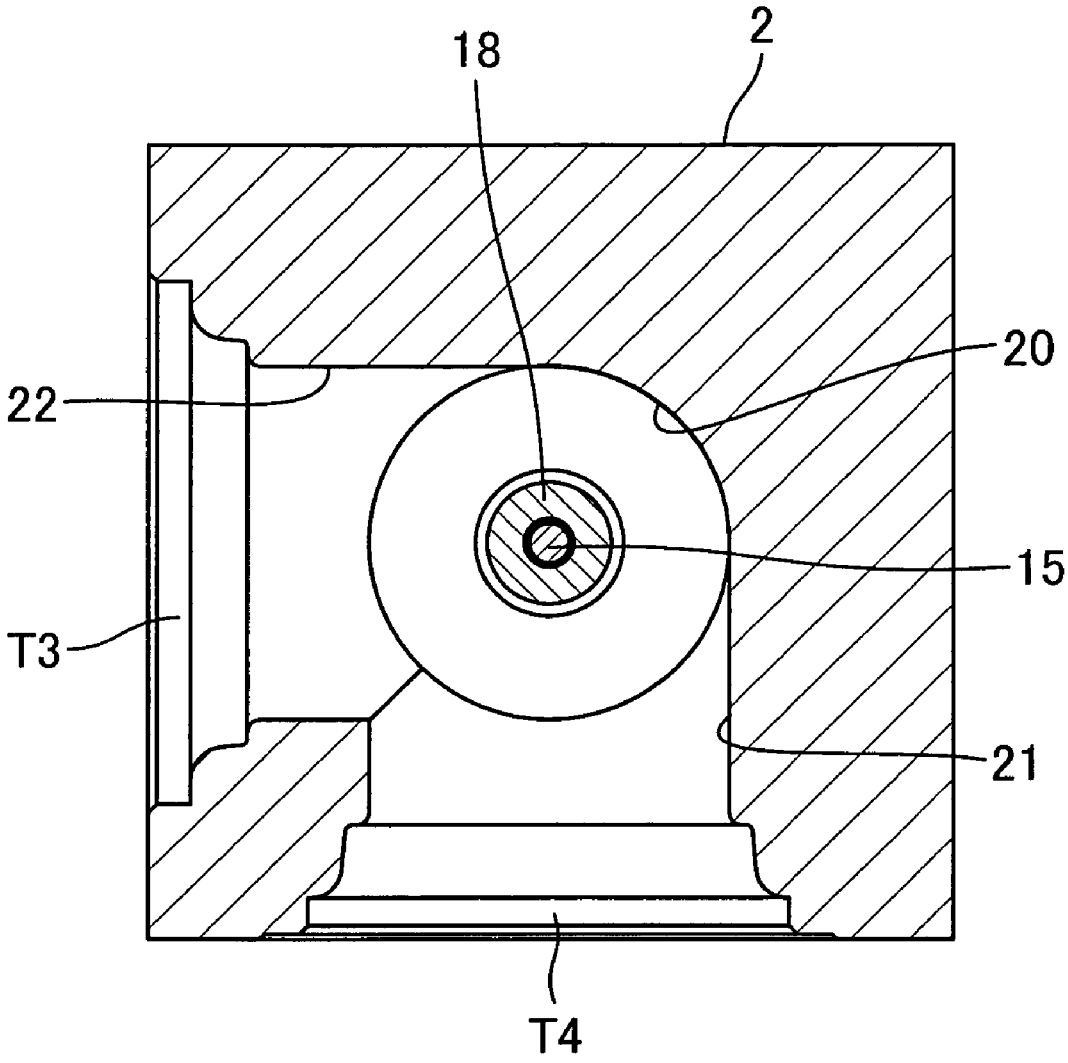
FIG. 5 is a cross-sectional view of the expansion valve taken on line C-C of FIG. 1.
Figure 6:
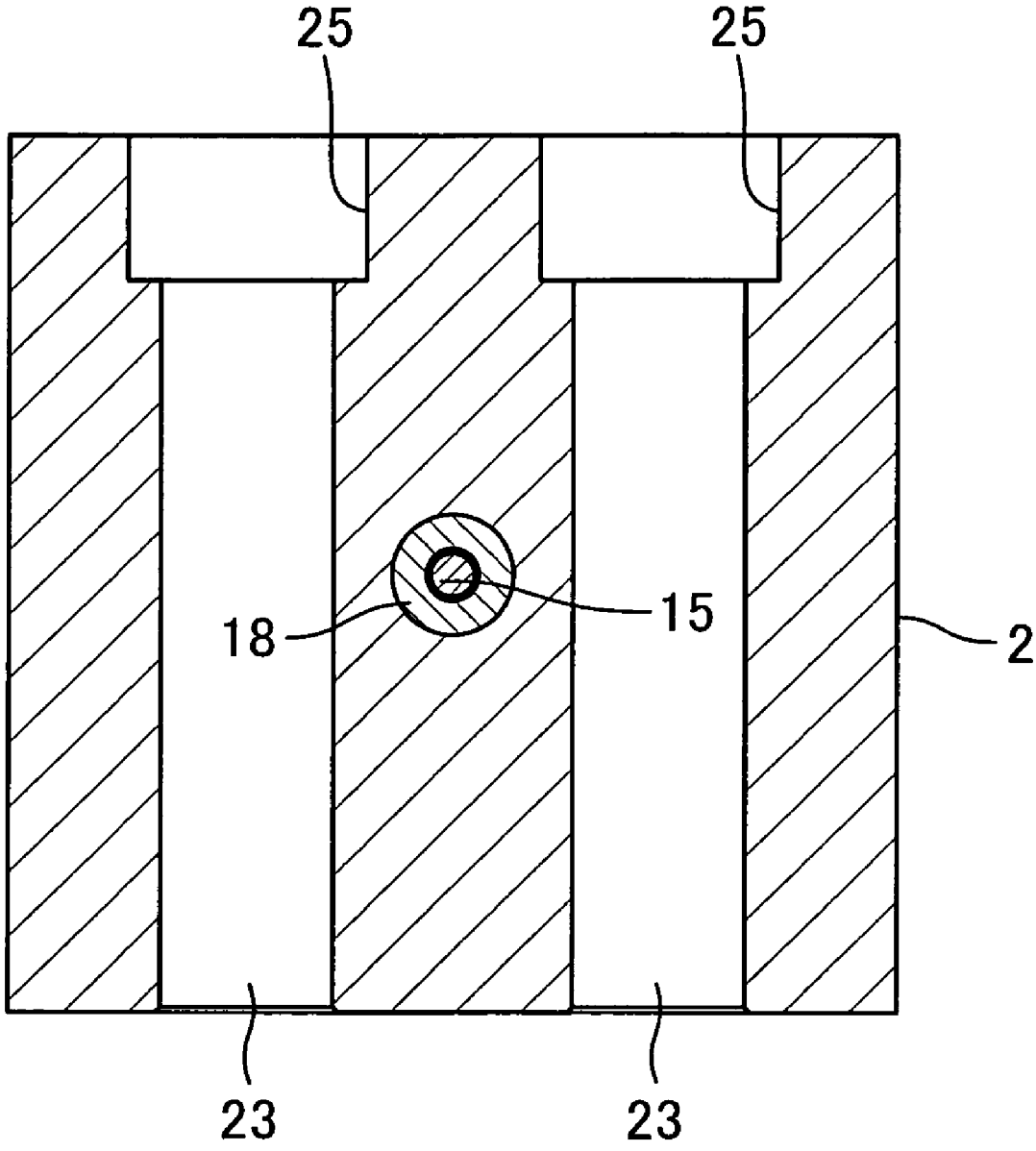
FIG. 6 is a Cross-sectional view of the expansion valve taken on line D-D of FIG. 2.

FIG. 1 is a front view showing the appearance of an expansion valve according to a first embodiment of the present invention. FIG. 2 is a side view showing the appearance of the expansion valve according to the first embodiment. FIG. 3 is a cross-sectional view of the expansion valve taken on line A-A of FIG. 1. FIG. 4 is a cross-sectional view of the expansion valve taken on line B-B of FIG. 2. FIG. 5 is a cross-sectional view of the expansion valve taken on line C-C of FIG. 1. FIG. 6 is a cross-sectional view of the expansion valve taken on line D-D of FIG. 2.

Referring first to FIG. 1, the expansion valve 1 according to the first embodiment includes a body block 2 having a front surface formed with a high-pressure inlet port T1 to which is connected a high-pressure refrigerant pipe for receiving high-temperature, high-pressure refrigerant from a condenser, and a low-pressure outlet port T4 connected to a refrigerant pipe leading to a compressor. As shown in FIG. 2, the body block 2 has a left side surface thereof formed with a low-pressure outlet port T2 to which is connected a low-pressure refrigerant pipe for supplying low-temperature, low-pressure refrigerant expanded and reduced in pressure by the expansion valve 1 to an evaporator, and a low-pressure inlet port 3 connected to a refrigerant pipe extending from the outlet of the evaporator.

As shown in FIG. 3 and FIG. 4, within the body block 2, there is formed a fluid passage communicating between the port T1 and the port T2, in which a valve seat 3 is integrally formed with the body block 2, and a ball-shaped valve element 4 is disposed on the upstream side of the valve seat 3 in a manner opposed to the valve seat 3. As a result, a gap between the valve seat 3 and the valve element 4 forms a variable orifice for restricting high-pressure refrigerant, and the refrigerant undergoes adiabatic expansion when it flows through the variable orifice.

Further, in a portion of the fluid passage toward the high-pressure inlet port T1, there are disposed a valve element receiver 5 for receiving the valve element 4, and a compression coil spring 6 urging the valve element 4 via the valve element receiver 5 in the direction of seating the valve element 4 on the valve seat 3. The compression coil spring 6 is received by a spring receiver 7 and an adjustment screw 8 screwed into the body block 2 for adjustment of load of the compression coil spring 6.

At the upper end of the body block 2, there is provided a power element 9 which comprises an upper housing 10 and a lower housing 11, made of thick metal, a diaphragm 12 made of a thin metal plate having flexibility and disposed in a manner dividing the space enclosed by the housings, and a disk 13 disposed below the diaphragm 12. The space enclosed by the upper housing 10 and the diaphragm 12 forms a temperature-sensing chamber which is filled with refrigerant gas and the like, and is sealed with a metal ball 14 joined to the upper housing 10 by resistance-welding. The disk 13 has an upper part formed with an increased diameter such that the part radially protrudes outward, and the underside of the increased diameter portion is configured to be brought into abutment with the inner wall surface of the lower housing 11 opposed thereto such that the underside functions as a stopper limiting the downward motion of the diaphragm 12, thereby defining the maximum valve lift of the expansion valve 1.

Below the disk 13, a shaft 15 is disposed for transmitting displacement of the diaphragm 12 to the valve element 4. The shaft 15 is inserted through a through hole 16 formed in the center of the body block 2.

The through hole 16 has an expanded upper portion thereof, and an O ring 17 is disposed at a stepped portion thereof. The O ring 17 seals a gap between the shaft 15 and the through hole 16, thereby preventing refrigerant from leaking into a low-pressure passage between the ports T3 and T4.

Further, the upper end of the shaft 15 is held by a holder 18 which has a hollow cylindrical portion extending downward across the low-pressure passage between the ports T3 and T4. The lower end of the holder 18 is fitted in the expanded portion of the through hole 16 and the lower end face restricts the motion of the O ring 17 toward the upper open end of the through hole 16.

At the upper end of the holder 18, the disk 13 is movably held in the direction of displacement of the diaphragm 12, and further a spring 19 is disposed for urging the shaft 15 from a radial direction. This configuration of applying lateral load to the shaft 15 with the spring 19 prevents the axial motion of the shaft 15 from sensitively reacting to changes in pressure of the high-pressure refrigerant introduced into the high-pressure inlet port T1, to thereby form a vibration suppressing mechanism for suppressing generation of untoward vibration noise caused by vibrations of the shaft 15 in the axial direction. Further, the top of the holder 18 has a pressure equalizing passage formed therethrough for causing the low-pressure passage communicating between the ports T3 and T4 to communicate with the space below the diaphragm 12, such that the refrigerant returned from the evaporator can enter the space below the diaphragm 12.

As shown in FIGS. 3 to 5, the low-pressure passage communicating between the ports T3 and T4 is formed by boring a cylindrical hole 20 from the upper surface of the body block 2 using a tool, such as an end mill, further, making a hole 21 coaxial with the port T4 from the front side surface of the body block 2 using a drill such that the hole 21 communicates with the hole 20, and making a hole 22 coaxial with the port T3 from the left side surface of the body block 2 using a drill such that the hole 22 communicates with the hole 20. At this time, the holes 20, 21, and 22 are formed to have the same diameter, with central axes thereof being orthogonal to each other, whereby the outer peripheral portion of an intersecting portion of the low-pressure passage has a radiused shape. Therefore, when the refrigerant flows through the low-pressure passage, the radiused shape of the intersecting portion along which the refrigerant flows at an increased speed makes the flow of refrigerant non-turbulent to cause the refrigerant to flow smoothly, whereby it is possible to reduce generation of untoward noise caused by turbulence of the flow of the refrigerant and noise of the flow of refrigerant.

Further, as shown in FIG. 2 and FIG. 3, the body block 2 is formed with through holes 23 for having bolts passed therethrough for mounting the expansion valve, and, as shown in FIG. 1 and FIG. 3, a screw hole 24 for having a stud bolt implanted therein for mounting the expansion valve. As shown in FIG. 6, the through holes 23 for having the bolts passed therethrough each have one open end thereof formed with a countersunk hole 25 coaxial therewith. Due to this configuration, by passing the mounting bolts through the through holes 23 such that the heads of the bolts are positioned in the countersunk holes 25, it is possible to prevent the heads of the bolts from protruding from the body block 2, thereby making it possible to further reduce installation space for the expansion valve 1. The power element 9 on the top of the body block 2 is covered with a heat-resistant cap 26. The heat-resistant cap 26 is used particularly in the case where the expansion valve 1 is disposed within an engine room. This is because the temperature of the atmosphere within the engine room becomes very high, and therefore with a view to improvement in the temperature characteristics of the expansion valve 1, the power element 9 is prevented from being adversely affected by the high temperature of the atmosphere within the engine room.

In the expansion valve 1 configured as above, before an air conditioner is started, the power element 9 detects a sufficiently higher temperature than when the air conditioner is in operation, so that the pressure in the temperature-sensing chamber of the power element 9 is high, causing the diaphragm 12 to be displaced downward, as viewed in the figures, and the disk 13 is brought into abutment with the lower housing 11. The displacement of the diaphragm 12 is transmitted to the valve element 4 of a valve portion via the shaft 15, whereby the expansion valve 1 is fully opened. Therefore, at the start of the air conditioner, the expansion valve 1 supplies refrigerant to the evaporator at a maximum flow rate.

As the temperature of the refrigerant returned from the evaporator is lowered, the temperature in the temperature-sensing chamber of the power element 9 is lowered, whereby the refrigerant gas in the temperature-sensing chamber is condensed on the inner surface of the diaphragm 12. This causes the pressure in the temperature-sensing chamber to be reduced to displace the diaphragm 12 upward, so that the shaft 15 is pushed by the compression coil spring 6, to move upward. As a result, the valve element 4 is moved toward the valve seat 3, whereby the passage area of the variable orifice is reduced to decrease the flow rate of refrigerant sent into the evaporator. Thus, the valve lift of the expansion valve 1 is set to a value corresponding to a flow rate dependent on the cooling load.

Figure 7:
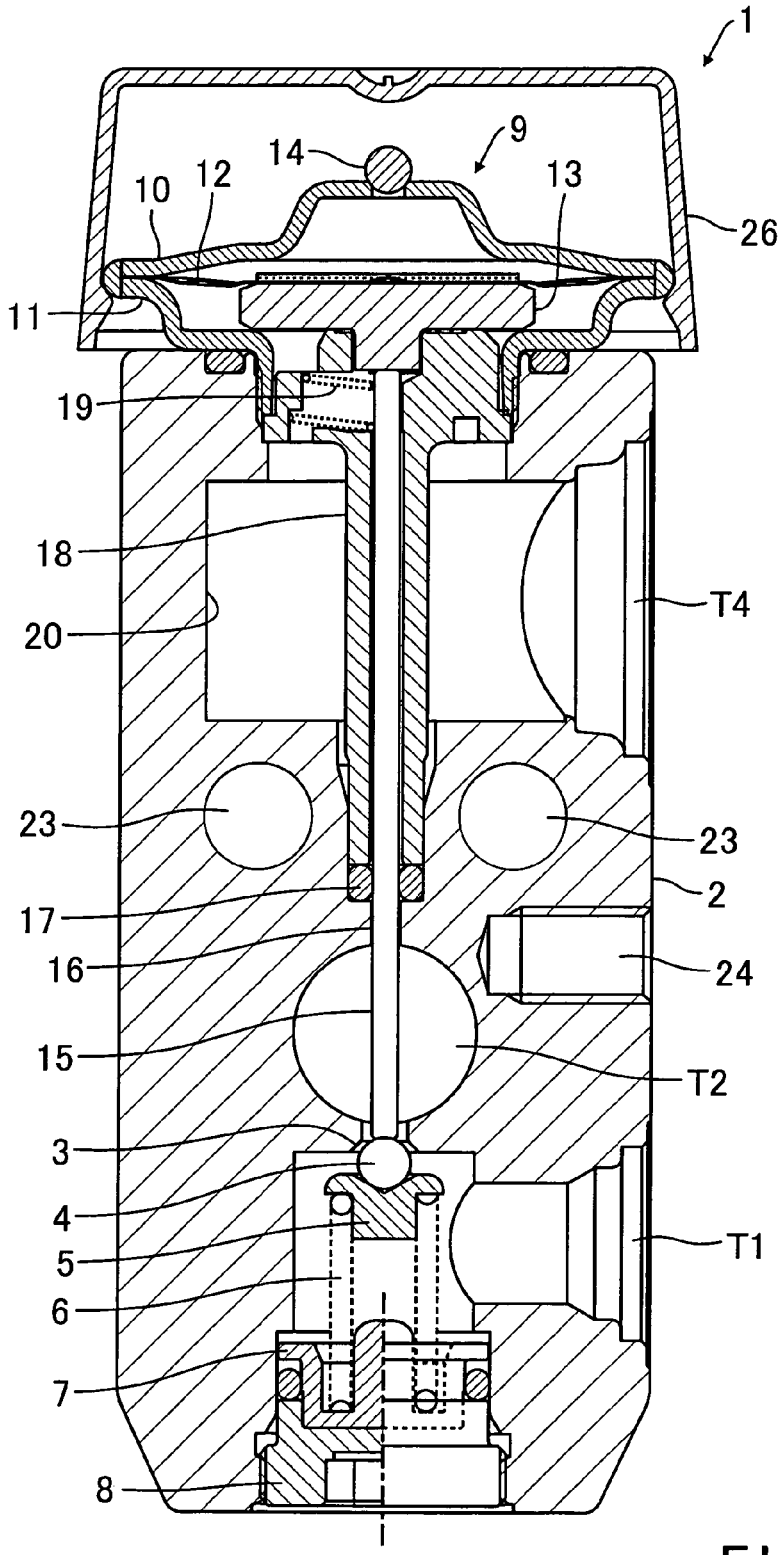
FIG. 7 is a longitudinal cross-sectional view showing an expansion valve according to a second embodiment of the present invention, as viewed from a plane passing through the axes of a high-pressure inlet port and a low-pressure outlet port.
Figure 8:
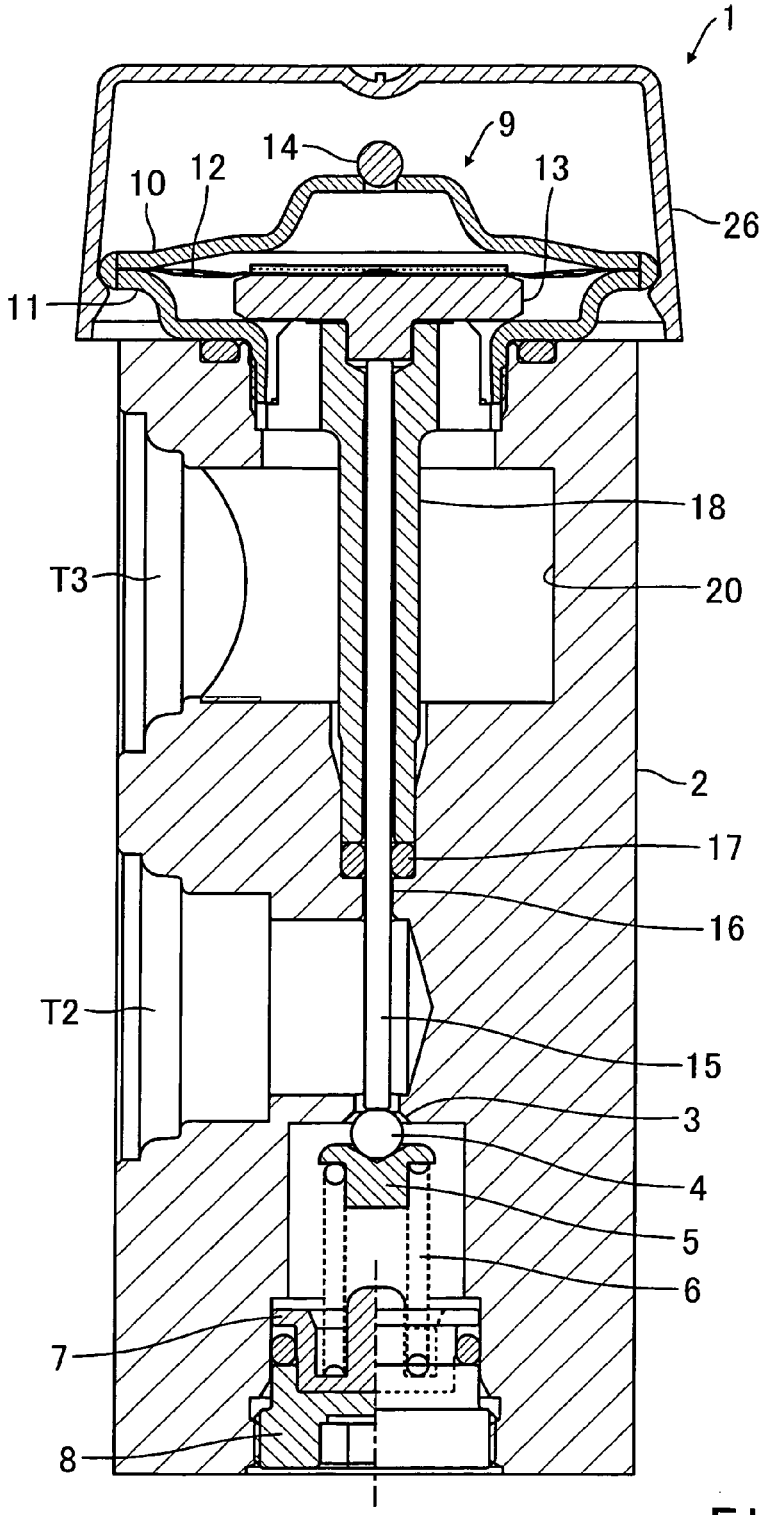
FIG. 8 is a longitudinal cross-sectional view showing the expansion valve according to the second embodiment, as viewed from a plane passing through the axes of a low-pressure inlet port and a low-pressure outlet port connected to an evaporator.
Figure 9:
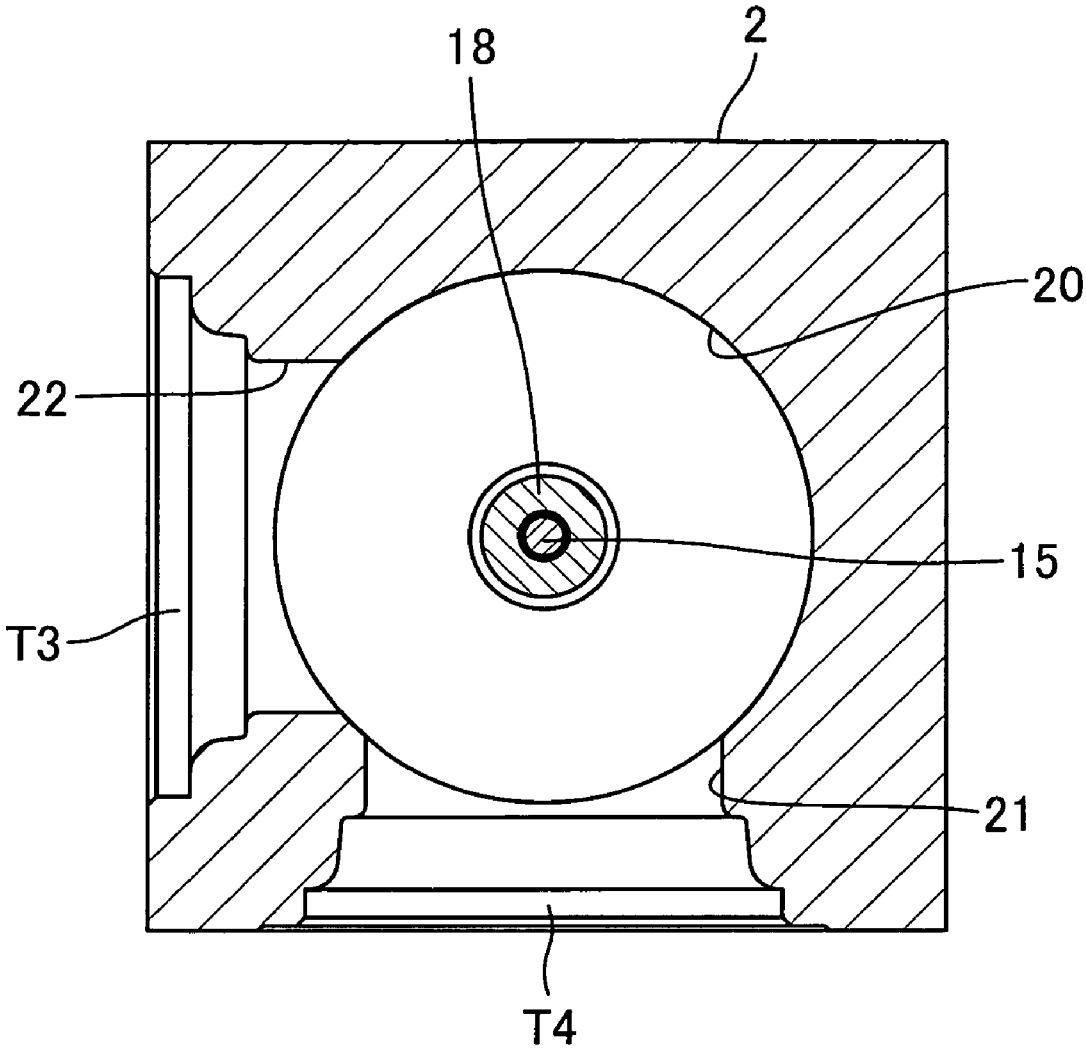
FIG. 9 is a transverse cross-sectional view showing the expansion valve according to the second embodiment, as viewed from a plane passing through the axes of a low-pressure passage.

FIG. 7 is a longitudinal cross-sectional view showing an expansion valve according to a second embodiment of the present invention, as viewed from a plane passing through the axes of a high-pressure inlet port and a low-pressure outlet port. FIG. 8 is a longitudinal cross-sectional view showing the expansion valve according to the second embodiment, as viewed from a plane passing through the axes of a low-pressure inlet port and a low-pressure outlet port connected to an evaporator. FIG. 9 is a transverse cross-sectional view showing the expansion valve according to the second embodiment, as viewed from a plane passing through the axes of a low-pressure passage. It should be noted that the expansion valve according to the second embodiment has the same general view as that of the expansion valve according to the first embodiment, and hence figures showing the appearance thereof are omitted. Further, in FIGS. 7 to 9, component elements identical or equivalent to those shown in FIGS. 1 to 6 are designated by the same reference numerals, and detailed description thereof is omitted.

In the expansion valve according to the second embodiment, an intersecting portion of the low-pressure passage communicating between ports T3 and T4 is formed to be larger than the intersecting portion of the low-pressure passage of the expansion valve according to the first embodiment. More specifically, as shown in FIGS. 7 to 9, the intersecting portion of the low-pressure passage is formed by making a hole from the upper surface of the body block 2 using a tool, such as an end mill, then boring the hole using a tool, such as a boring tool, to thereby form a cylindrical hole 20, further drilling a hole 21 coaxial with a port T4 from the front side surface of the body block 2 such that the hole 21 communicates with the hole 20, and drilling a hole 22 coaxial with the port T3 from the left side surface of the body block 2 such that the hole 22 communicates with the hole 20. This makes it possible to cause the outer peripheral portion of the intersecting portion of the low-pressure passage to have a radiused shape, and the intersecting portion provides a wider passage. Therefore, when the refrigerant flows through the low-pressure passage, the radiused shape of the intersecting portion along which the refrigerant flows at an increased speed makes the flow of refrigerant non-turbulent to cause the refrigerant to flow smoothly, whereby it is possible to reduce generation of untoward noise caused by turbulence of the flow of refrigerant and noise of the flow of refrigerant.

Figure 10:
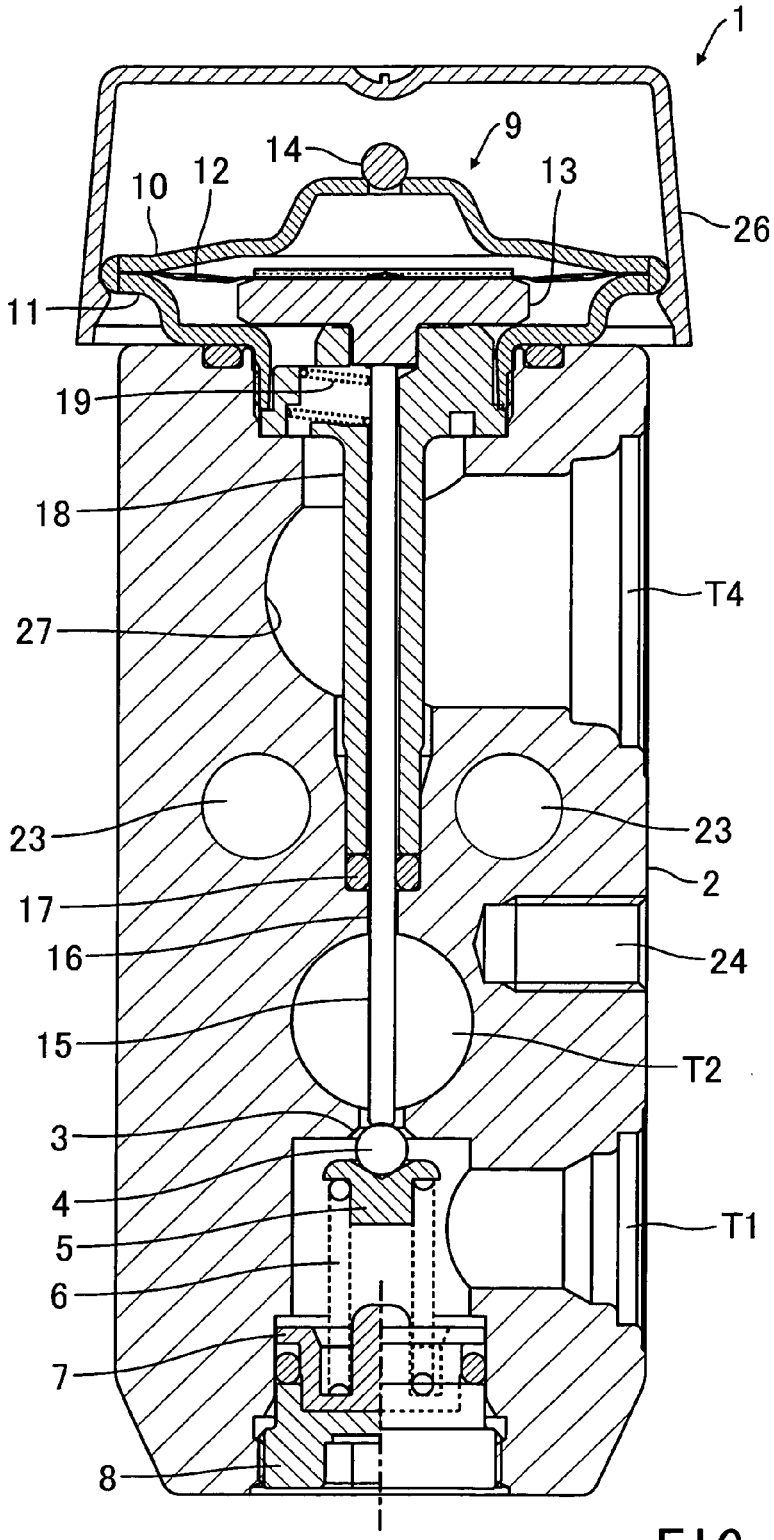
FIG. 10 is a longitudinal cross-sectional view showing an expansion valve according to a third embodiment of the present invention, as viewed from a plane passing through the axes of a high-pressure inlet port and a low-pressure outlet port.
Figure 11:
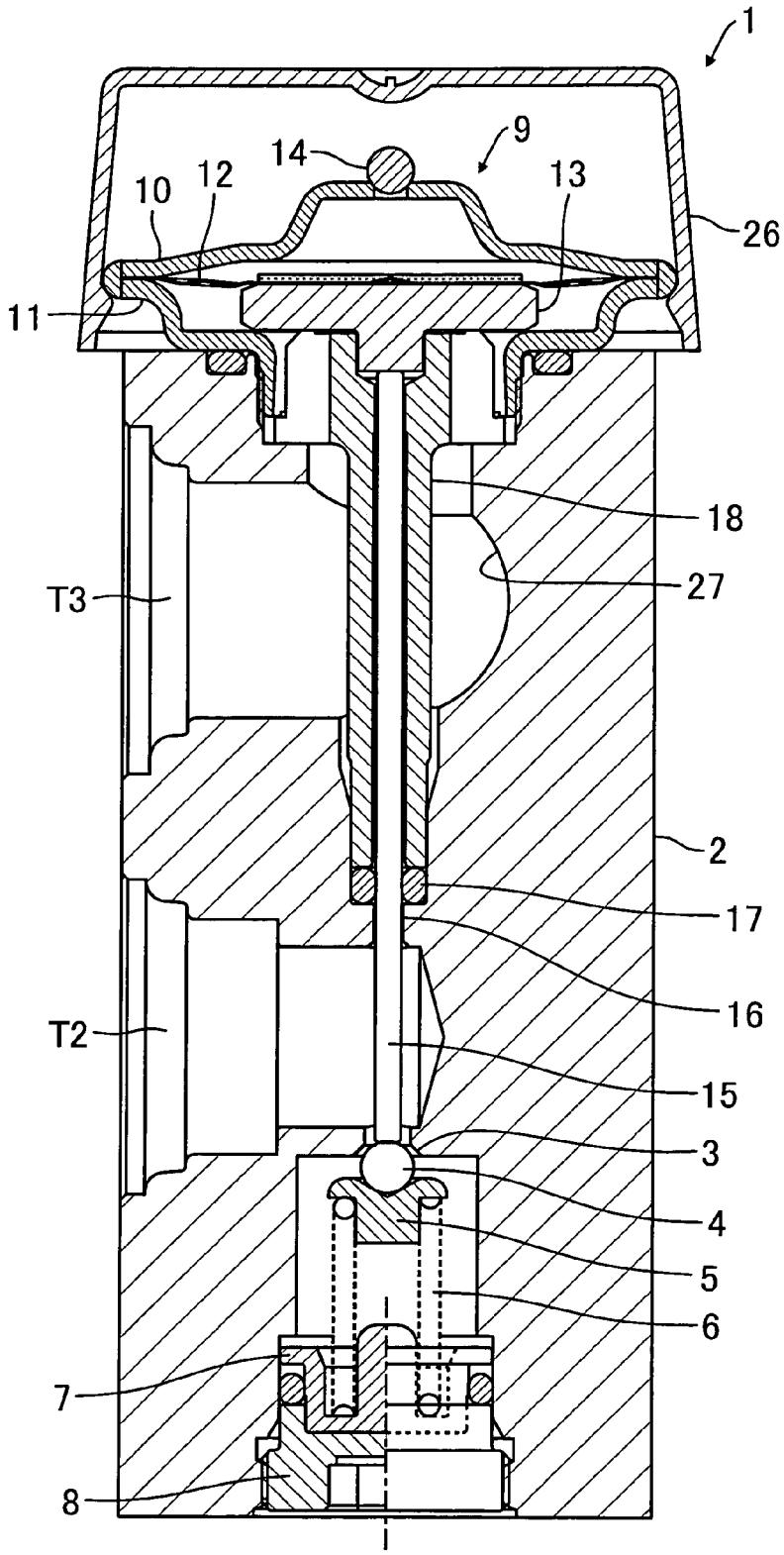
FIG. 11 is a longitudinal cross-sectional view showing the expansion valve according to the third embodiment, as viewed from a plane passing through the axes of a low-pressure inlet port and a low-pressure outlet port connected to an evaporator.
Figure 12:
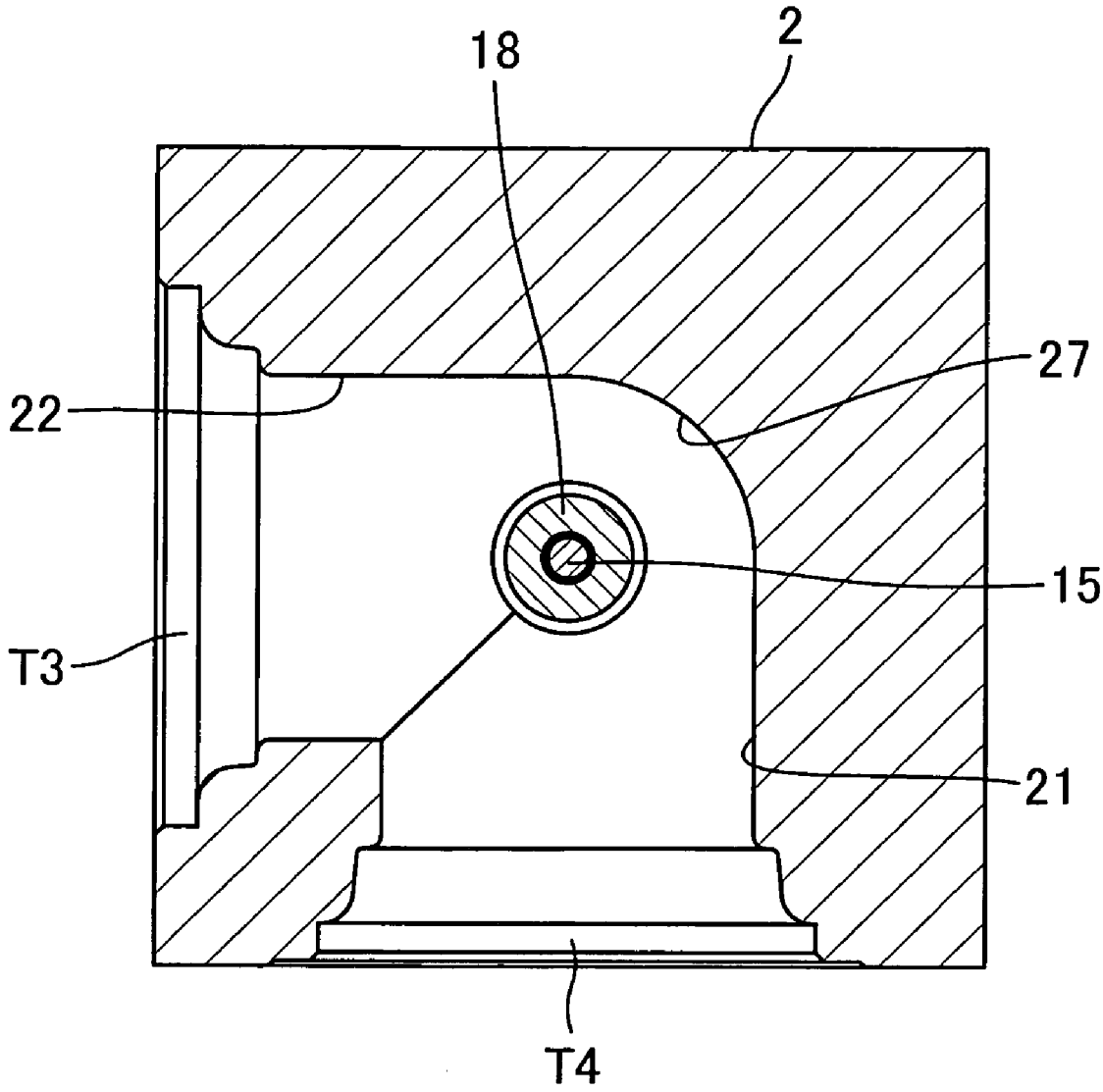
FIG. 12 is a transverse cross-sectional view showing the expansion valve according to the third embodiment, as viewed from a plane passing through the axes of a low-pressure passage.

FIG. 10 is a longitudinal cross-sectional view showing an expansion valve according to a third embodiment of the present invention, as viewed from a plane passing through the axes of a high-pressure inlet port and a low-pressure outlet port. FIG. 11 is a longitudinal cross-sectional view showing the expansion valve according to the third embodiment, as viewed from a plane passing through the axes of a low-pressure inlet port and a low-pressure outlet port connected to an evaporator. FIG. 12 is a transverse cross-sectional view showing the expansion valve according to the third embodiment, as viewed from a plane passing through the axes of a low-pressure passage. It should be noted that the expansion valve according to the third embodiment also has the same general view as that of the expansion valve according to the first embodiment, and hence figures showing the appearance thereof are omitted. Further, in FIGS. 10 to 12, component elements identical or equivalent to those shown in FIGS. 1 to 6 are designated by the same reference numerals, and detailed description thereof is omitted.

In the expansion valve according to the third embodiment, the low-pressure passage communicating between ports T3 and T4 is formed using a tool with a rounded tip. More specifically, a hole 21 coaxial with the port T4 is drilled from the front side surface of the body block 2 using a drill with a rounded tip, and then a hole 22 coaxial with the port T3 is drilled from the left side surface of the body block 2 using a drill with a rounded tip, whereby an intersecting portion of the low-pressure passage is formed. At this time, when one of the holes 21 and 22 is drilled, the drill for making the one hole is caused to stop at a position where the tip of the drill coincides with the inner wall of the other of the holes 21 and 22. As a result, the intersecting portion of the low-pressure passage has an outer peripheral portion thereof formed on an inner wall 27 which is radiused-shaped, following the contour of the tip of the drill. Therefore, since refrigerant introduced into the port T3 is caused to flow along the radiused-shaped inner wall 27 of the low-pressure passage, it is possible to reduce generation of untoward noise caused by turbulence of the flow of refrigerant and noise of the flow of refrigerant.

Figure 13:
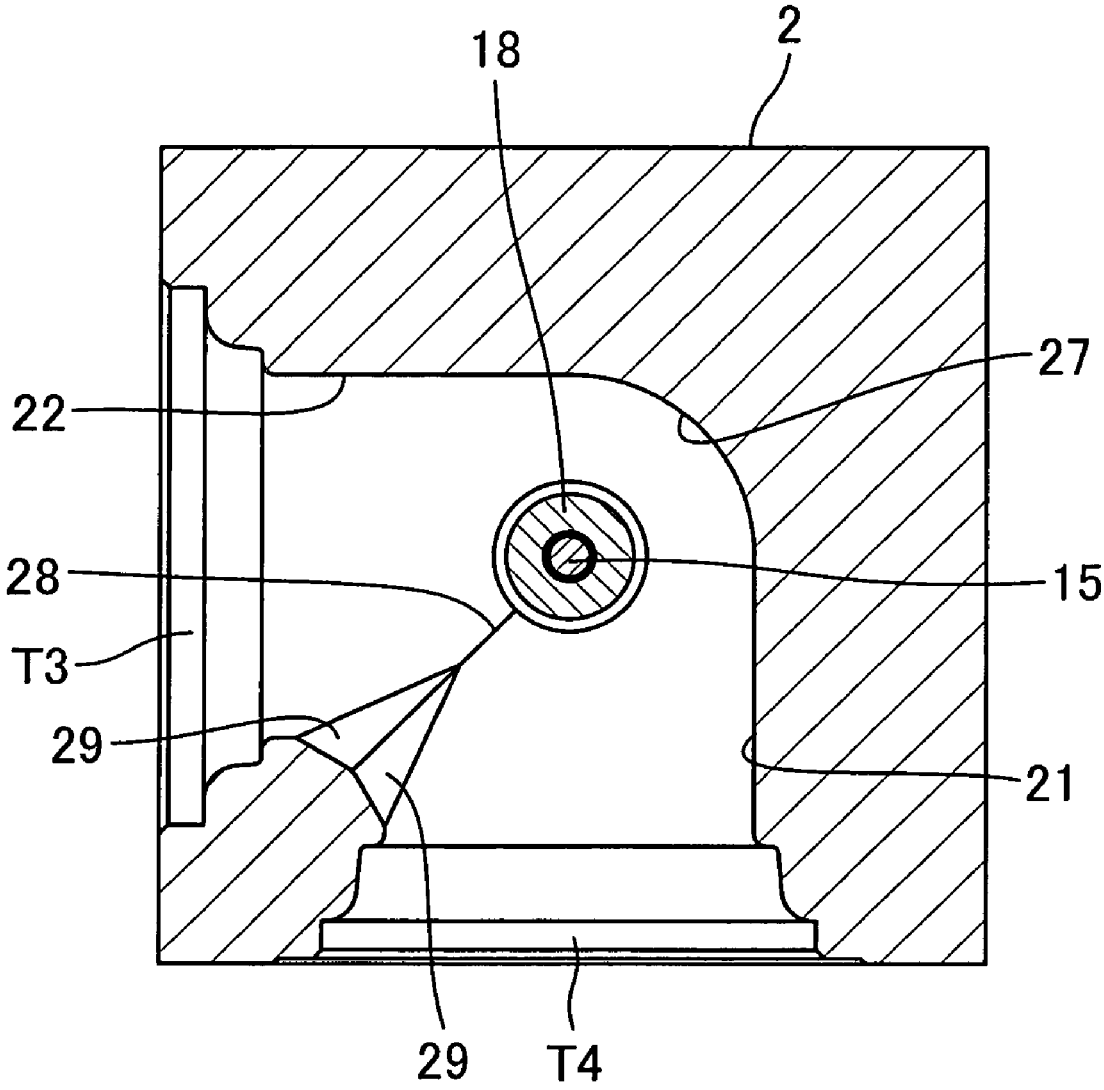
FIG. 13 is a transverse cross-sectional view showing an expansion valve according to a fourth embodiment of the present invention, as viewed from a plane passing through the axes of a low-pressure passage.

FIG. 13 is a transverse cross-sectional view showing an expansion valve according to a fourth embodiment of the present invention, as viewed from a plane passing through the axes of a low-pressure passage. It should be noted that the expansion valve according to the fourth embodiment has the same general view and longitudinal cross-sectional configuration as those of the expansion valve according to the third embodiment, and hence figures showing the appearance and longitudinal cross-sectional views thereof are omitted. Further, in FIG. 13, component elements identical or equivalent to those shown in FIG. 12 are designated by the same reference numerals, and detailed description thereof is omitted.

In the expansion valve according to the fourth embodiment, an intersecting portion of the low-pressure passage communicating between ports T3 and T4 is configured such that an edge line 28, which is a juncture of machined portions formed by drilling, is cut off therefrom, to thereby eliminate an edge portion from the inner peripheral side of the intersecting portion. The edge line 28 is cut off with a tool, such as a machining tool or an end mill, inserted into each of the ports T3 and T4. As a result, the inner wall surface of the intersecting portion is chamfered to form cut faces 29, and the edge portion of the expansion valve according to the third embodiment, having an angle of 90 degrees, is caused to have a larger angle. This makes it possible to cause refrigerant to smoothly flow along the inner peripheral side of the intersecting portion, thereby making it possible to further reduce generation of untoward noise and noise of the flow of refrigerant.

Figure 14:
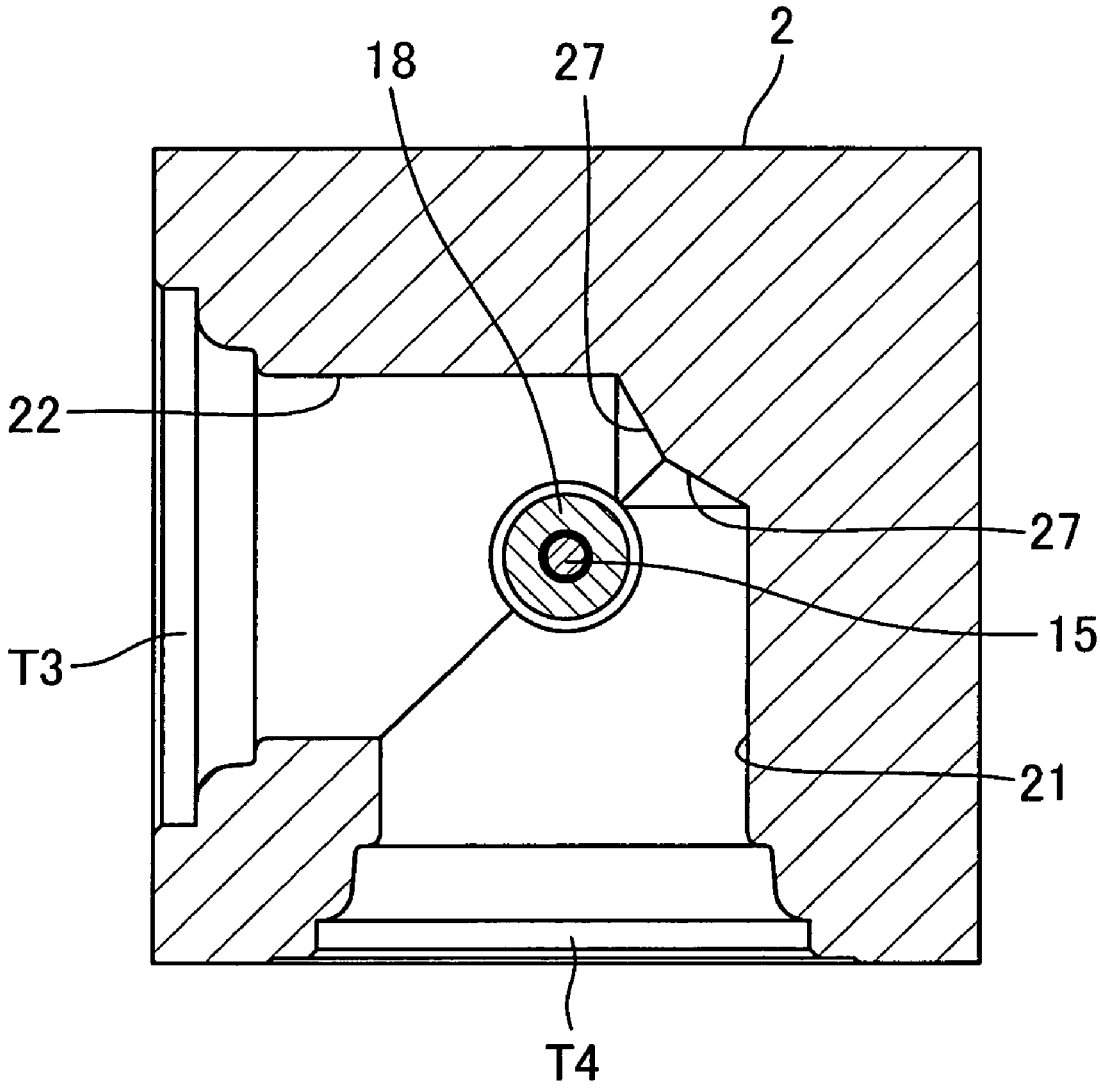
FIG. 14 is a transverse cross-sectional view showing an expansion valve according to a fifth embodiment of the present invention, as viewed from a plane passing through the axes of a low-pressure passage.

FIG. 14 is a transverse cross-sectional view showing an expansion valve according to a fifth embodiment of the present invention, as viewed from a plane passing through the axes of a low-pressure passage. It should be noted that the expansion valve according to the fifth embodiment has the same general view and longitudinal cross-sectional configuration as those of the expansion valve according to the third embodiment, and hence figures showing the appearance and longitudinal cross-sectional views thereof are omitted. Further, in FIG. 14, component elements identical or equivalent to those shown in FIG. 12 are designated by the same reference numerals, and detailed description thereof is omitted.

In the expansion valve according to the fifth embodiment, the low-pressure passage communicating between ports T3 and T4 is formed using a tool having a tip angle (cutting edge angle) of 120 degrees. More specifically, a hole 21 coaxial with the port T4 is drilled from the front side surface of the body block 2 using a drill having a tip angle of 120 degrees, and then a hole 22 coaxial with the port T3 is drilled from the left side surface of the body block 2 using a drill having a tip angle of 120 degrees, whereby an intersecting portion of the low-pressure passage is formed. When the holes 21 are 22 drilled, the drills are caused to stop at respective locations before the respective tips of the drills reach the inner walls of the holes 21 and 22. As a result, the intersecting portion of the low-pressure passage has an outer peripheral portion thereof formed on an inner wall 27 formed by a combination of shapes following the contours of the tips of the drills. At this time, although an edge portion, which is a juncture of machined portions, is formed by drilling using the tips of the drills, no significant turbulence of the flow of refrigerant is caused by the edge portion since the edge portion has an obtuse angle of 150 degrees. Therefore, when refrigerant introduced into the port T3 flows in an outer peripheral portion of the low-pressure passage, it flows substantially along the inner wall 27, so that it is possible to reduce generation of untoward noise caused by turbulence of the flow of refrigerant and noise of the flow of refrigerant.

Figure 15:
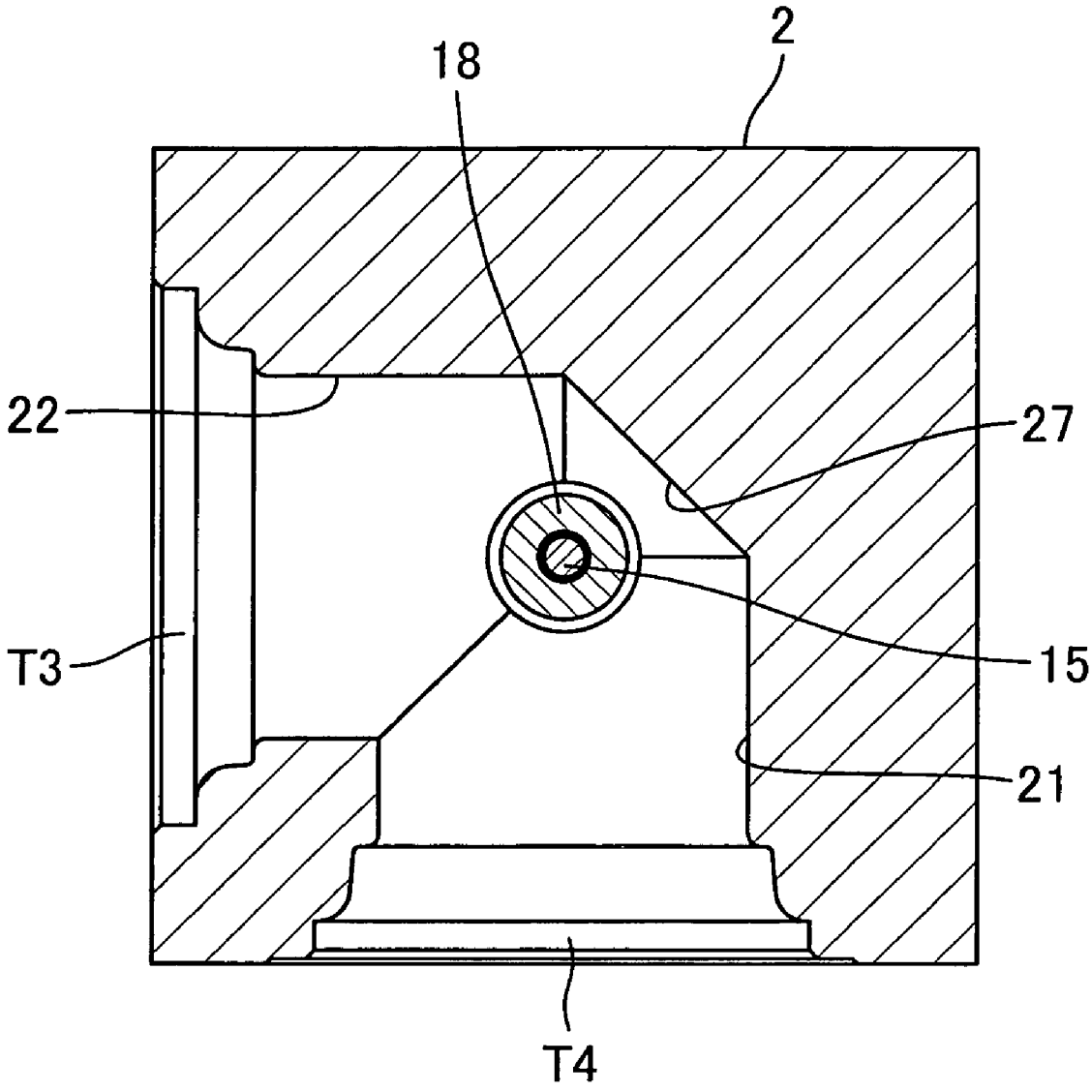
FIG. 15 is a transverse cross-sectional view showing an expansion valve according to a sixth embodiment of the present invention, as viewed from a plane passing through the axes of a low-pressure passage.

FIG. 15 is a transverse cross-sectional view showing an expansion valve according to a sixth embodiment, as viewed from a plane passing through the axes of a low-pressure passage. It should be noted that the expansion valve according to the sixth embodiment has the same general view and longitudinal cross-sectional configuration as those of the expansion valve according to the third embodiment, and hence figures showing the appearance and longitudinal cross-sectional views thereof are omitted. Further, in FIG. 15, component elements identical or equivalent to those shown in FIG. 14 are designated by the same reference numerals, and detailed description thereof is omitted.

In the expansion valve according to the sixth embodiment, the low-pressure passage communicating between ports T3 and T4 is formed using a tool having a tip angle (cutting edge angle) of 90 degrees. More specifically, a hole 21 coaxial with the port T4 is drilled from the front side surface of the body block 2 using a drill having a tip angle of 90 degrees, and then a hole 22 coaxial with the port T3 is drilled from the left side surface of the body block 2 using a drill having a tip angle of 90 degrees, whereby an intersecting portion of the low-pressure passage is formed. When one of the holes 21 and 22 is made by drilling, the drill is caused to stop at a position where the tip of the drill coincides with the inner wall of the other of the holes 21 and 22. As a result, the intersecting portion of the low-pressure passage has an outer peripheral portion thereof formed on an inner wall 27 having a shape following the shape of the tip of the drill. Therefore, refrigerant introduced into the port T3 flows along the inner wall 27 of the low-pressure passage, so that it is possible to reduce generation of untoward noise caused by turbulence of the flow of refrigerant and noise of the flow of refrigerant.

Figure 16:
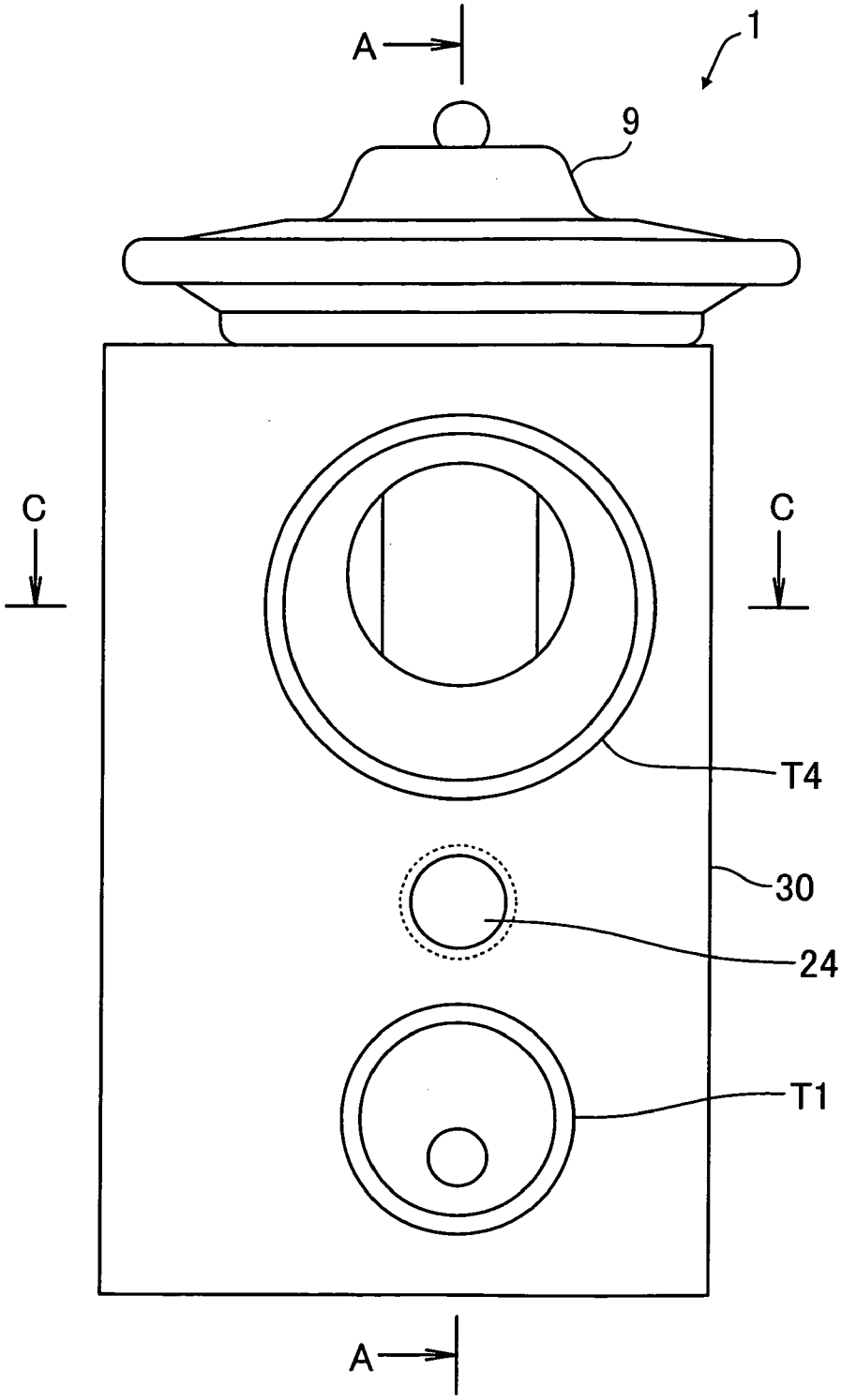
FIG. 16 is a front view showing the appearance of an expansion valve according to a seventh embodiment of the present invention.
Figure 17:
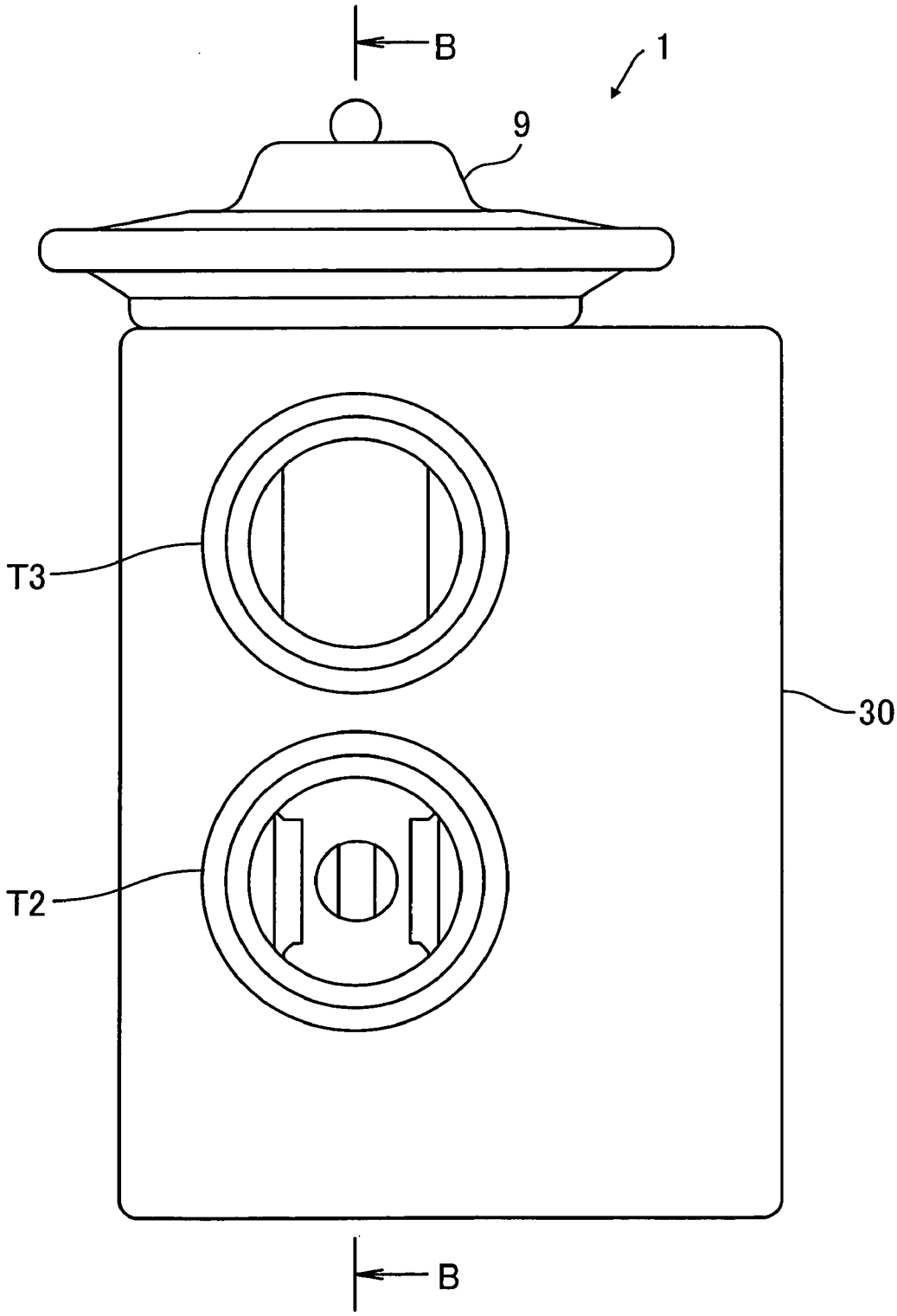
FIG. 17 is a side view showing the appearance of the expansion valve according to the seventh embodiment.
Figure 18:
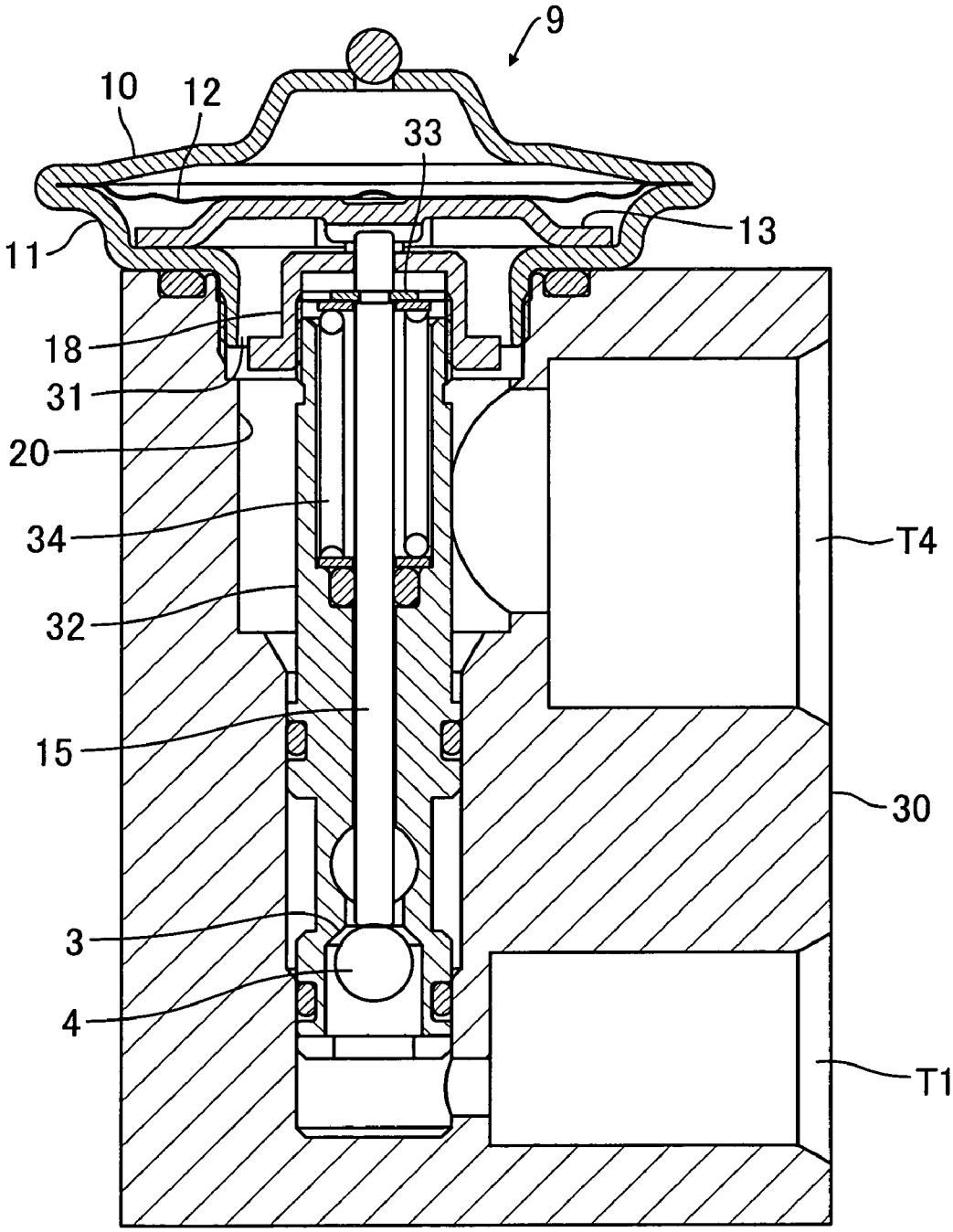
FIG. 18 is a cross-sectional view of the expansion valve taken on line A-A of FIG. 16.
Figure 19:
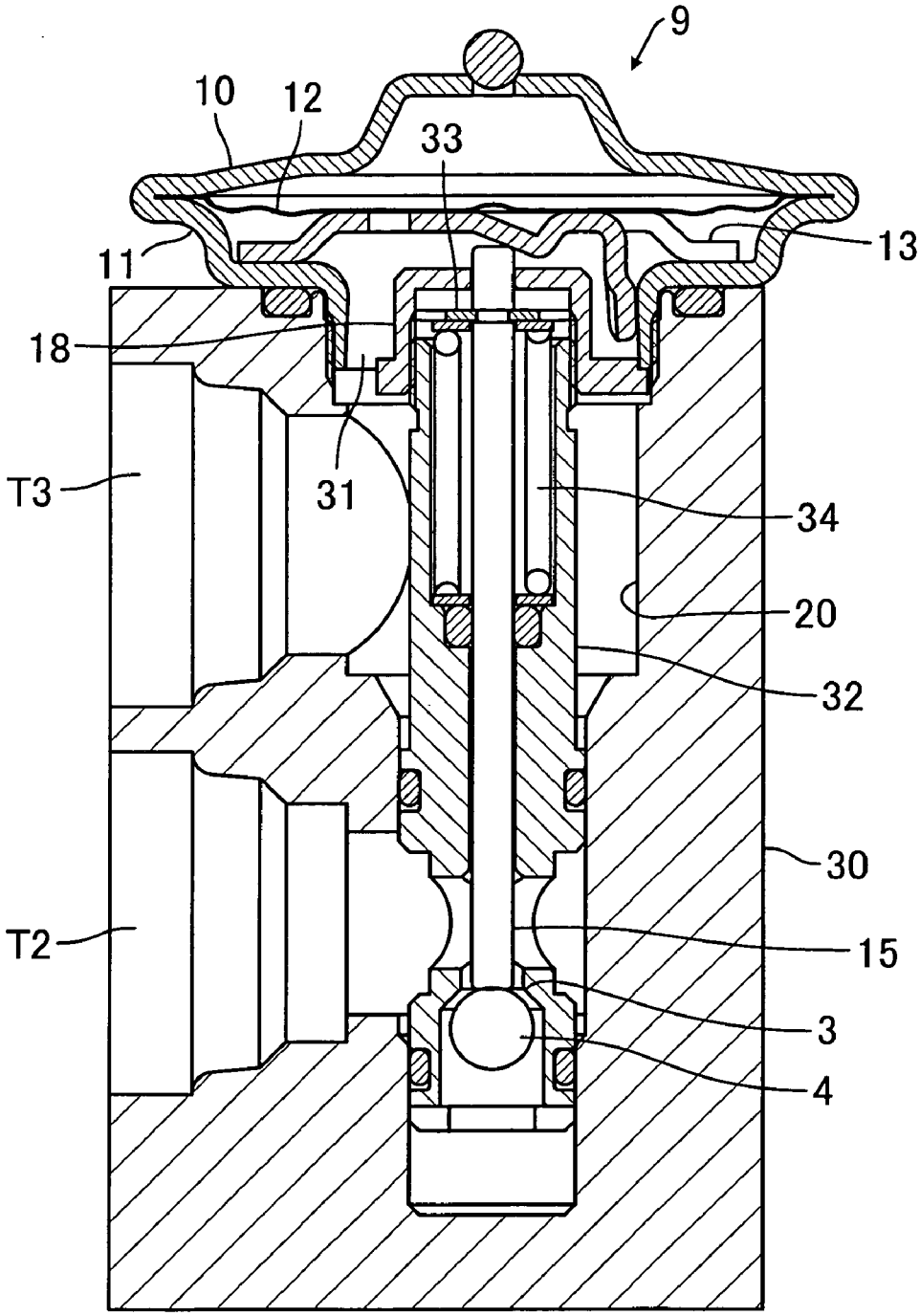
FIG. 19 is a cross-sectional view of the expansion valve taken on line B-B of FIG. 17.
Figure 20:
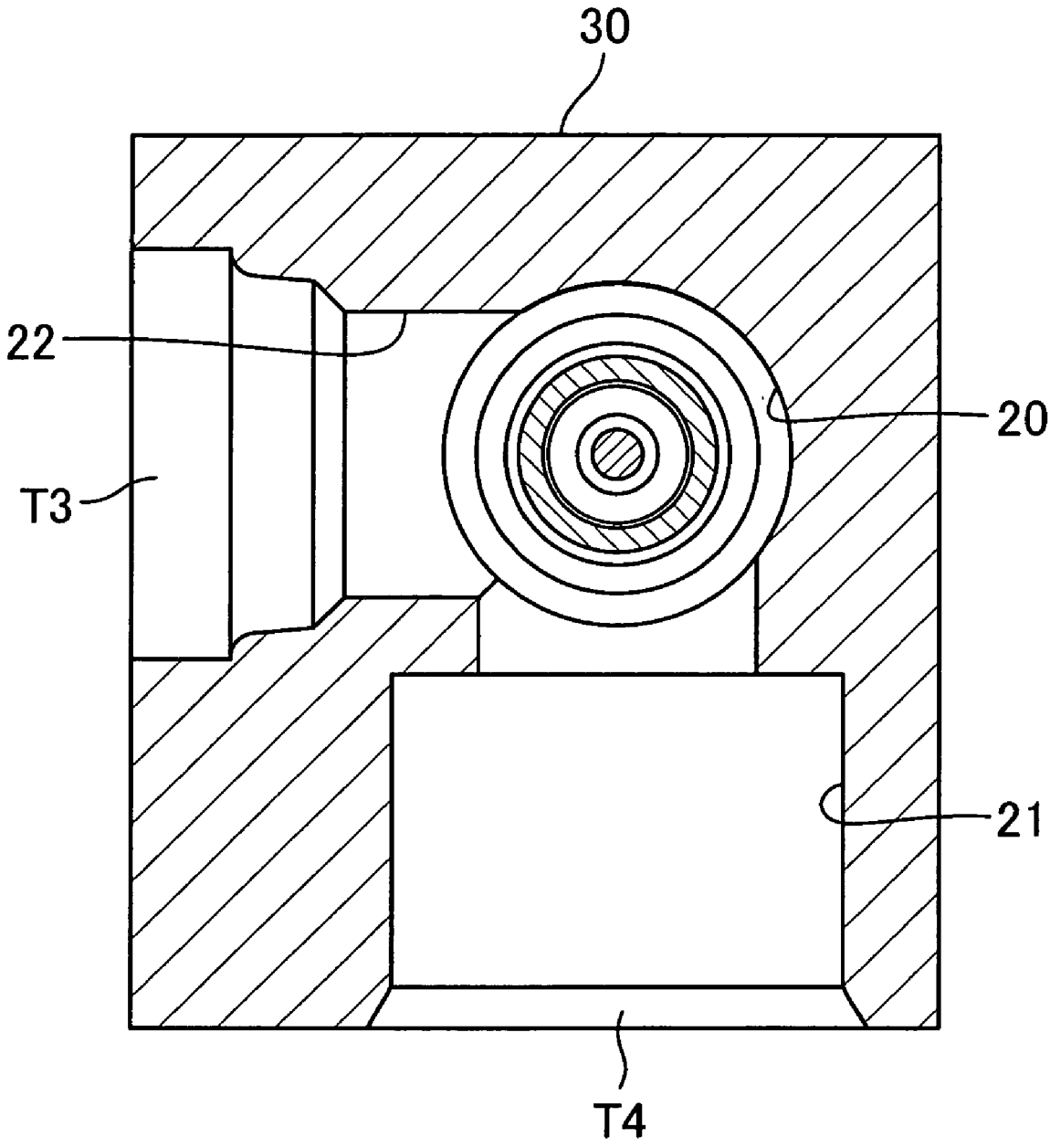
FIG. 20 is a cross-sectional view of the expansion valve taken on line C-C of FIG. 16.

FIG. 16 is a front view showing the appearance of an expansion valve according to a seventh embodiment of the present invention. FIG. 17 is a side view showing the appearance of the expansion valve according to the seventh embodiment. FIG. 18 is a cross-sectional view of the expansion valve taken on line A-A of FIG. 16. FIG. 19 is a cross-sectional view of the expansion valve taken on line B-B of FIG. 17. FIG. 20 is a cross-sectional view of the expansion valve taken on line C-C of FIG. 16. In FIGS. 16 to 20, component elements identical or equivalent to, those shown in FIGS. 1 to 5 are designated by the same reference numerals, and detailed description thereof is omitted.

In contrast to the expansion valves 1 according to the first to sixth embodiments, which are of a so-called block type, the expansion valve 1 according to the seventh embodiment is called a plug type expansion valve. This expansion valve 1 includes a plug having a valve portion and a power element 9 and functioning as an expansion valve, and a valve casing 30, and is assembled by inserting and rigidly fixing the plug in the valve casing 30. As shown in FIGS. 16 and 17, the valve casing 30 has ports T1 and T4 and ports T2 and T3 formed in two adjacent side surfaces thereof.

Referring to FIG. 20, a low-pressure passage communicating between the ports T3 and T4 is formed by boring a cylindrical hole 20 from the upper surface of the valve casing 30 using a tool, such as an end mill, further drilling a hole 21 coaxial with the port T4 from the front side surface of the valve casing 30 using a drill such that the hole 21 communicates with the hole 20, and drilling a hole 22 coaxial with the port T3 from the left side surface of the valve casing 30 using a drill such that the hole 22 communicates with the hole 20. The plug disposed across the low-pressure passage has a diameter larger than the outer diameter of the holder 18 of the expansion valve 1 according to each of the first to sixth embodiments, and therefore the hole 20 is configured to have a larger diameter than those of the holes 21 and 22. This eliminates edge portions having an acute angle from an inner wall of the low-pressure passage on an outer peripheral side thereof, so that when refrigerant flows through the low-pressure passage, it smoothly flows through the intersecting portion, which makes it possible to reduce generation of untoward noise and noise of the flow of refrigerant.

As shown in FIGS. 18 and 19, the power element 9 of the plug comprises an upper housing 10, a lower housing 11, a diaphragm 12, and a disk 13. As shown in FIG. 19, the disk 13 has a central portion thereof integrally formed with an inclined surface portion inclined with respect to a plane in abutment with the diaphragm 12, and a sliding portion extended from the inclined surface portion in a manner hanging downward such that it is brought into contact with an inner wall surface of the lower housing 11.

The lower housing 11 has a holder 18 welded to a lower open end thereof. Part of the outer peripheral portion of the holder 18 welded to the lower housing 11 is formed with a pressure equalizing hole 31 that makes open a space below the diaphragm 12 within which the disk 13 is disposed.

The valve portion of the plug has a body 32 an upper end of which is screwed into the holder 18, and the body 32 has a shaft 15 axially movably held therein. The shaft 15 has an upper end extending through the holder 18 into the space below the diaphragm 12, for being brought into abutment with the inclined surface in the center of the disk 13. The shaft 15 has a ball-shaped valve element 4 spot-welded to the lower end face thereof. Therefore, the valve element 4 can move to and away from a valve seat 3 integrally formed with the body 32 according to the upward and downward movements of the shaft 15.

Further, the shaft 15 has a groove circumferentially formed in an upper portion thereof, in which is fitted a stopper 33. A spring 34 is disposed via a washer between the stopper 33 and a stepped portion formed in the body 32 in a manner surrounding the shaft 15. This configuration causes the spring 34 to always urge the shaft 15 against the inclined surface of the disk 13, with respect to the body 32, to thereby cause lateral load to be applied to the shaft 15, and at the same time urge the valve element 4 rigidly fixed on the shaft 15 in the valve-closing direction. Further, the spring 34 acts to cause a reaction force to the lateral load, which is applied to the shaft 15, to urge the sliding portion of the disk 13 against the inner wall surface of the lower housing 11. This imparts sliding resistance to the axial motion of the shaft 15, thereby suppressing undesired vibrations of the shaft 15 in the axial direction.

The body 32 screwed into the holder 18 can change the load of the spring 19 by having its amount of screwing into the holder 18 adjusted. This contributes to adjustment of the set point of the expansion valve 1.

The expansion valve 1 is assembled by mounting the plug configured as above in the valve casing 30. The plug is mounted in the valve casing 30 by inserting the plug into the valve casing 30 from above, and screwing the power element 9 into the valve casing 30 by a screw formed on the outer peripheral surface of the hanging portion of the lower housing 11. It should be noted that the operation of the expansion valve 1 configured as above is the same as the operations of the expansion valves 1 according to the first to sixth embodiments, and hence detailed description thereof is omitted.

Figure 21:
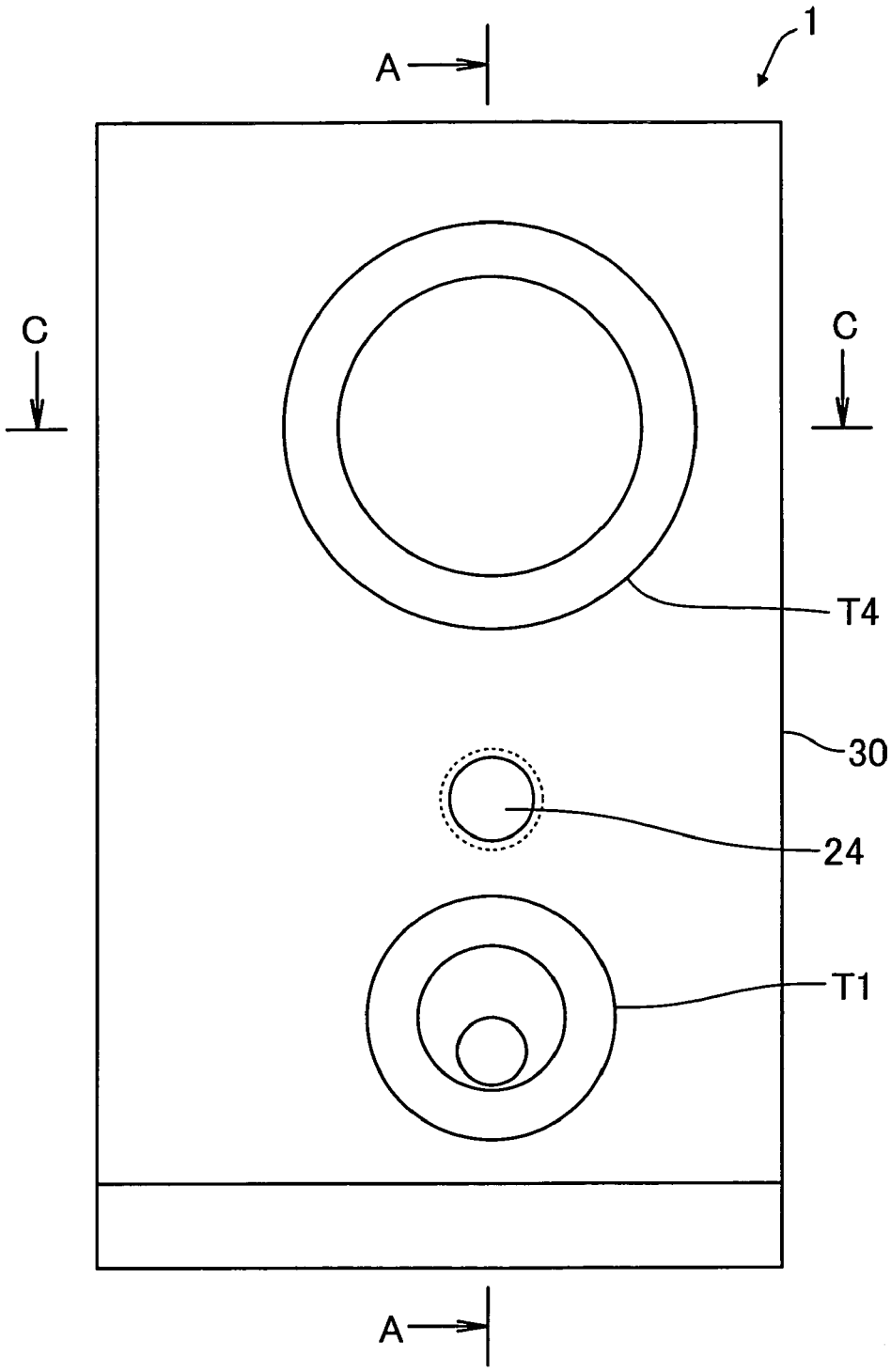
FIG. 21 is a front view showing the appearance of an expansion valve according to an eighth embodiment of the present invention.
Figure 22:
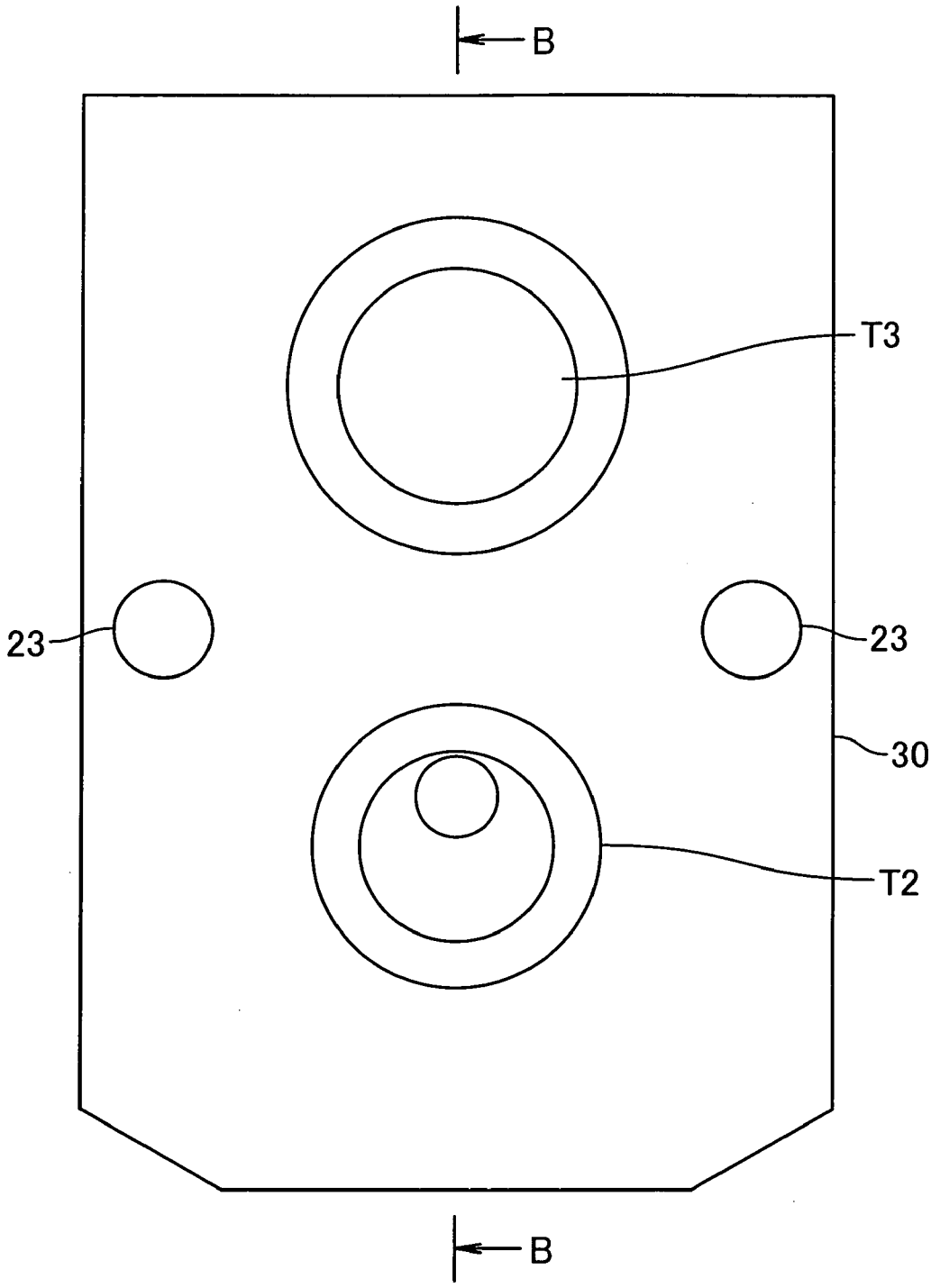
FIG. 22 is a side view showing the appearance of the expansion valve according to the eighth embodiment.
Figure 23:
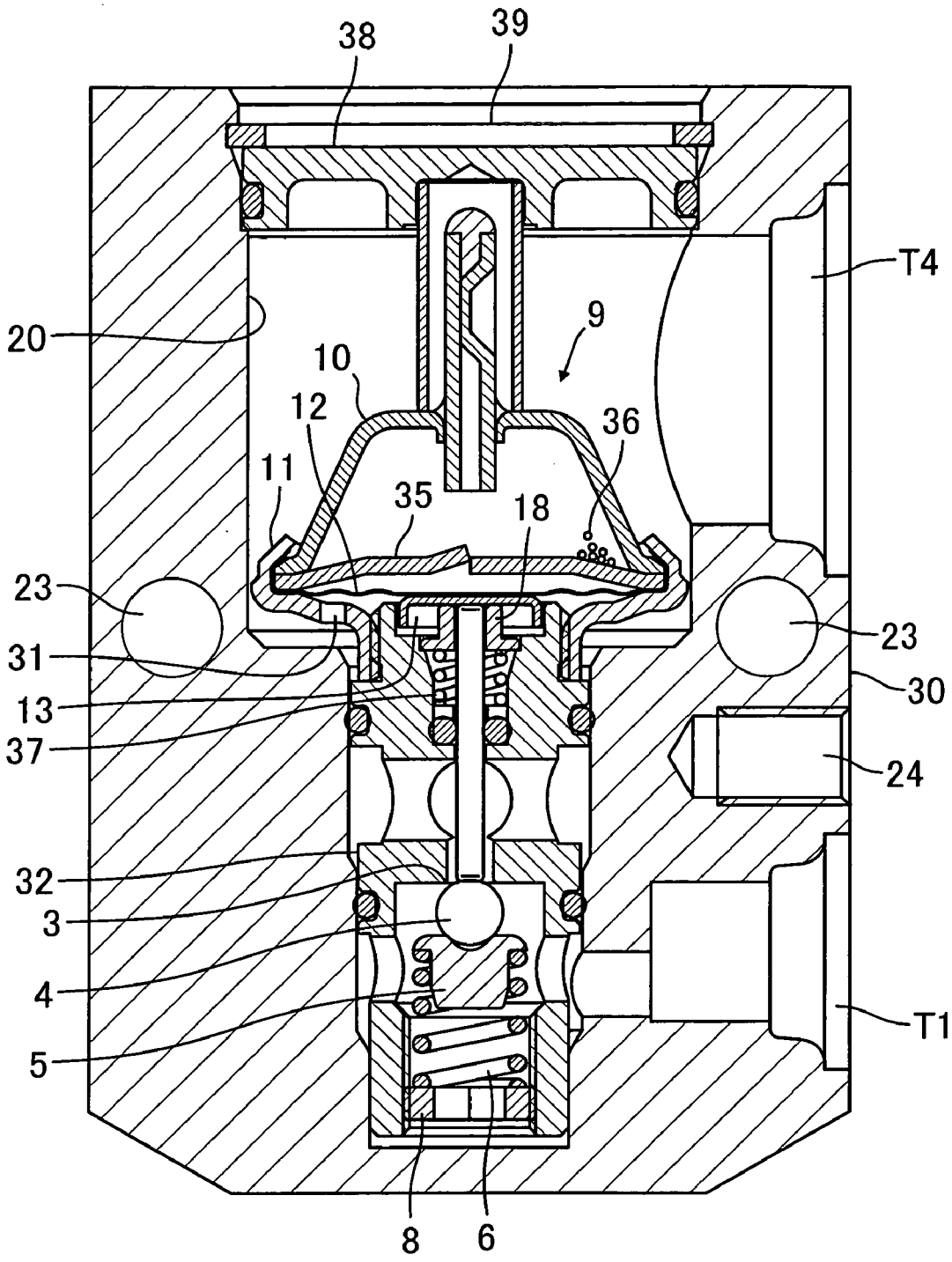
FIG. 23 is a cross-sectional view of the expansion valve taken on line A-A of FIG. 21.
Figure 24:
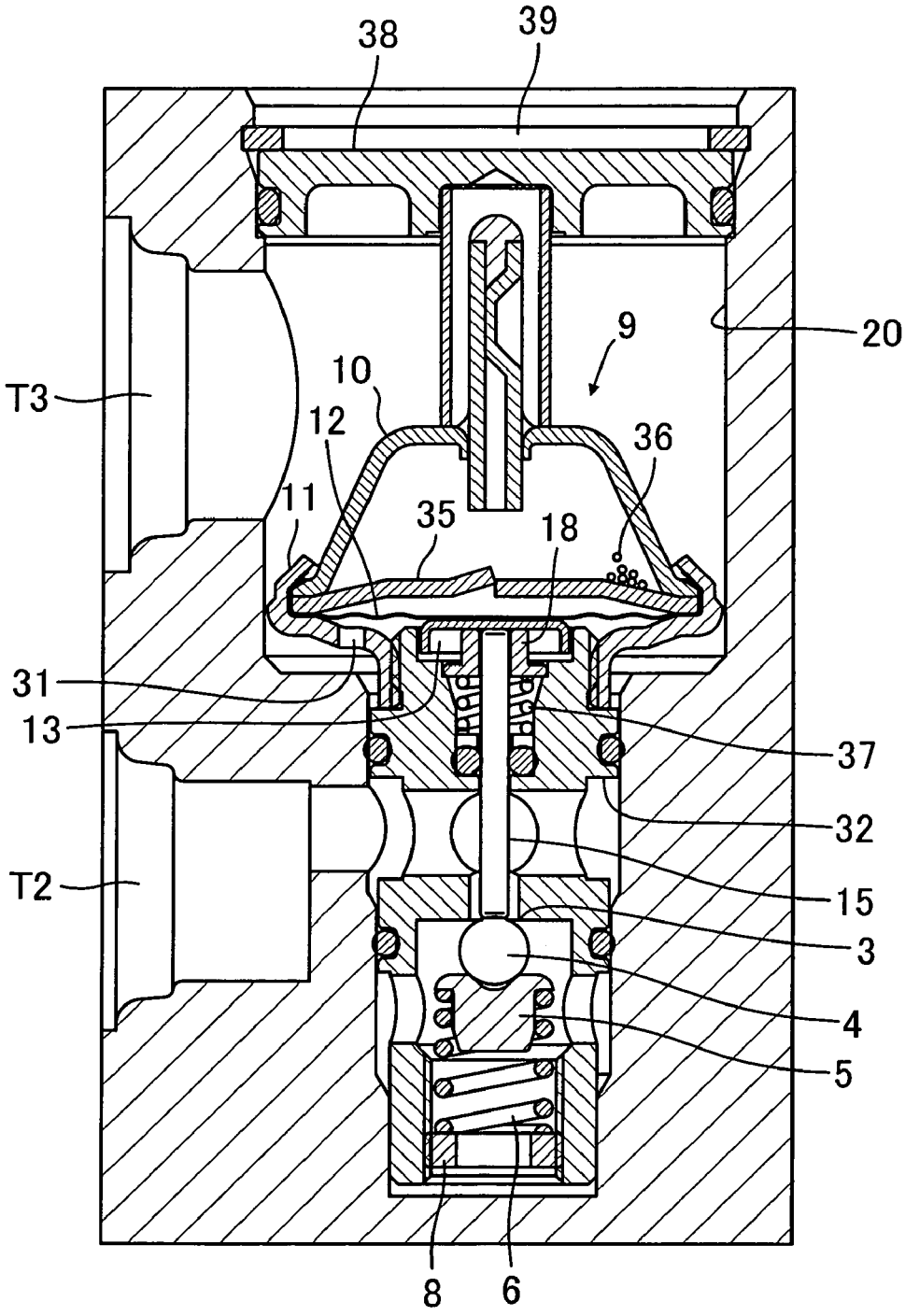
FIG. 24 is a cross-sectional view of the expansion valve taken on line B-B of FIG. 22.
Figure 25:
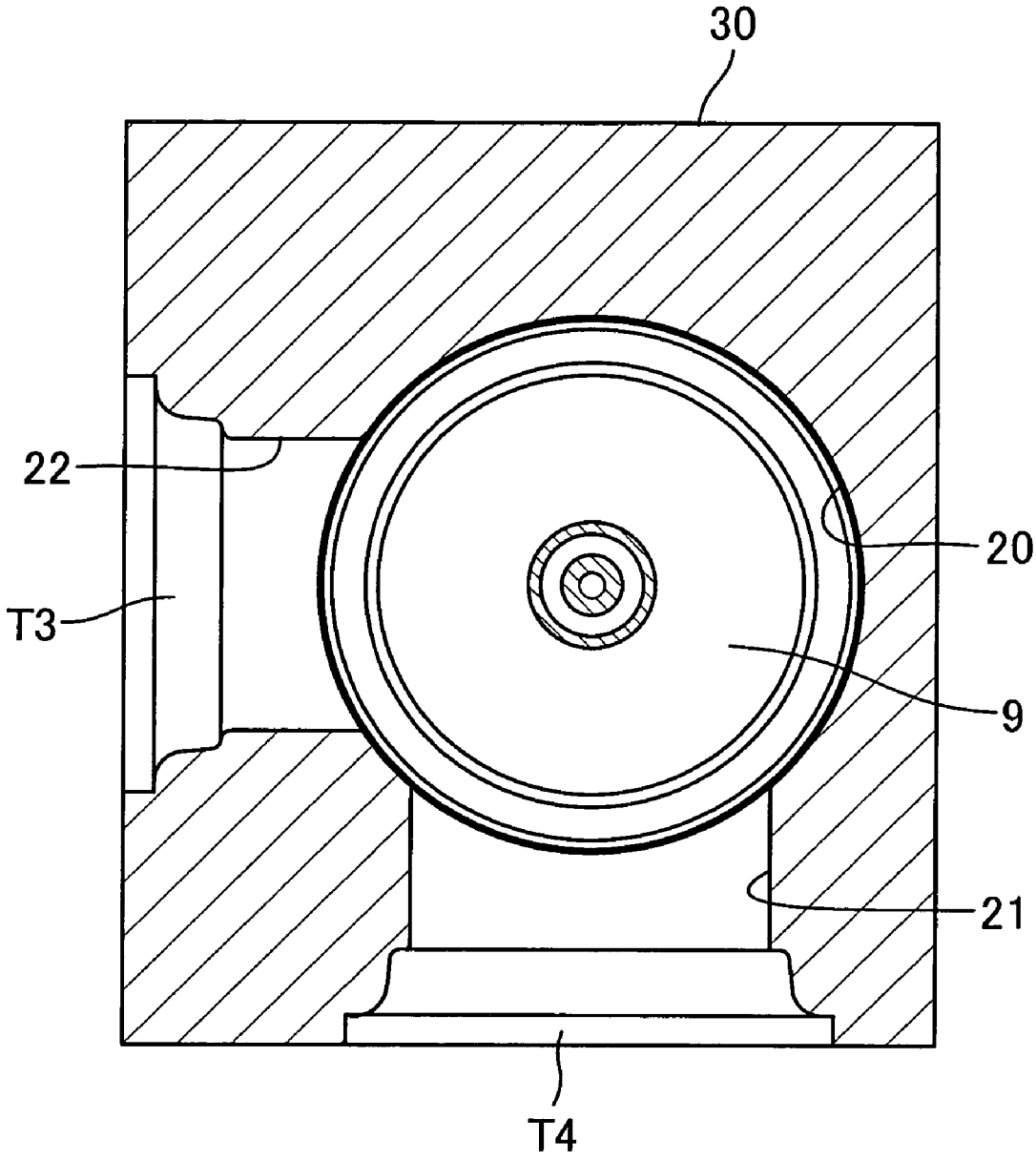
FIG. 25 is a cross-sectional view of the expansion valve taken on line C-C of FIG. 21.
Figure 26:
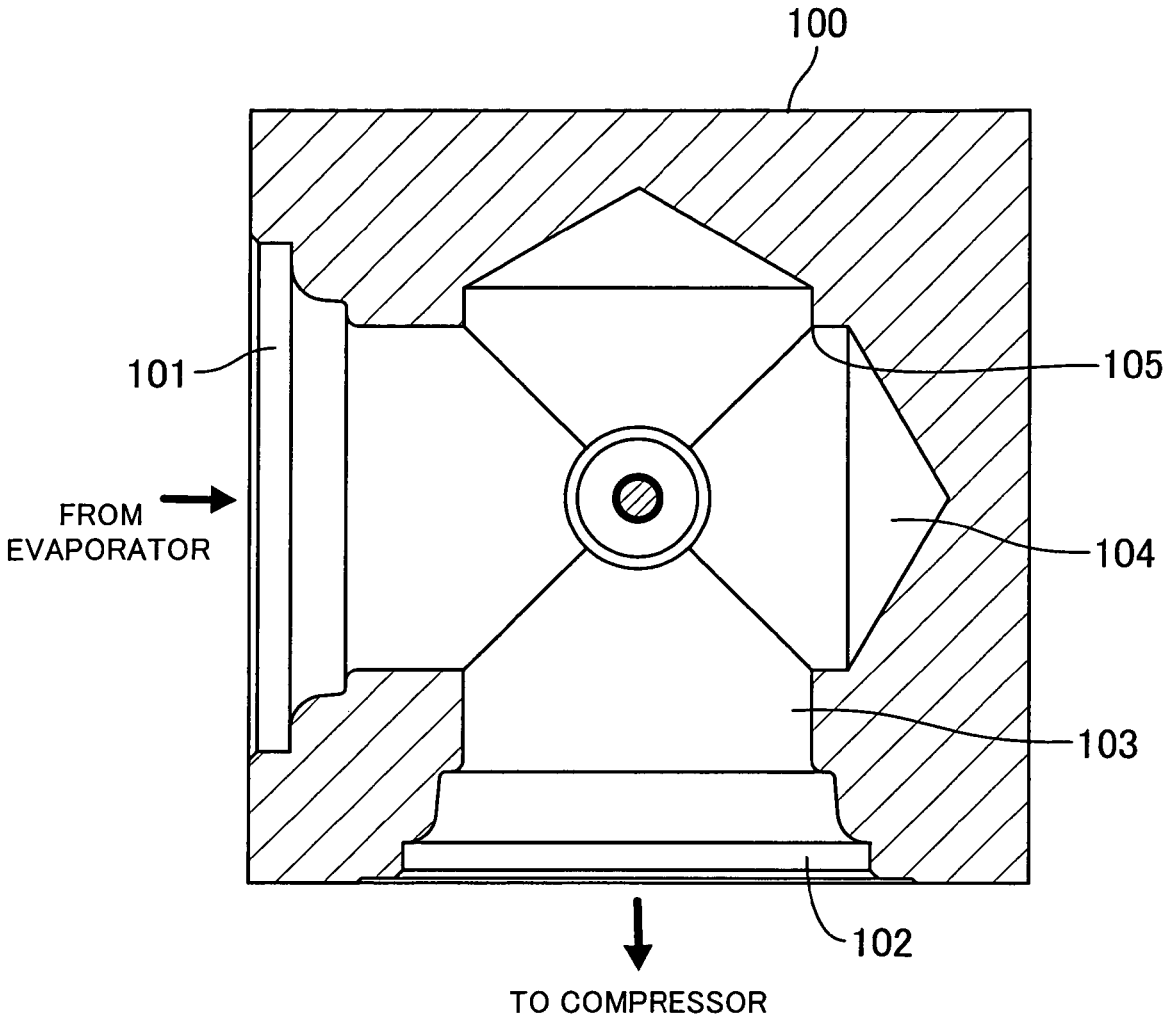
FIG. 26 PRIOR ART
FIG. 26 is a cross-sectional view of a low-pressure passage of a conventional expansion valve.

FIG. 21 is a front view showing the appearance of an expansion valve according to an eighth embodiment of the present invention. FIG. 22 is a side view showing the appearance of the expansion valve according to the eighth embodiment. FIG. 23 is a cross-sectional view of the expansion valve taken on line A-A of FIG. 21. FIG. 24 is a cross-sectional view of the expansion valve taken on line B-B of FIG. 22. FIG. 25 is a cross-sectional view of the expansion valve taken on line C-C of FIG. 21. In FIGS. 21 to 25, component elements identical or equivalent to those shown in FIG. 16 to FIG. 20 are designated by the same reference numerals, and detailed description thereof is omitted.

The expansion valve 1 according to the eighth embodiment is called a capsule type expansion valve. The expansion valve 1 includes a capsule that has a valve portion and a power element 9 and functions as an expansion valve, and a valve casing 30, and is assembled by mounting the capsule into the valve casing 30. As shown in FIG. 21 and FIG. 22, the valve casing 30 has ports T1 and T4, and ports T2 and T3 formed in two adjacent side surfaces thereof.

As shown in FIG. 25, a low-pressure passage communicating between the ports T3 and T4 is formed by boring a cylindrical hole 20 from the upper surface of the valve casing 30 using a tool, such as an end mill, further making a hole 21 coaxial with the port T4 from the front side surface of the valve casing 30 using a drill such that the hole 21 communicates with the hole 20, and making a hole 22 coaxial with the port T3 from the left side surface of the valve casing 30 using a drill such that the hole 22 communicates with the hole 20. The low-pressure passage has the power element 9 of the capsule disposed therein, such that refrigerant flows through a space above the power element 9. Since the intersecting portion of the low-pressure passage has no edge portion having an acute angle on an inner wall on an outer peripheral side thereof, refrigerant can smoothly flow through the intersecting portion, whereby it is possible to reduce generation of untoward noise and noise of the flow of refrigerant.

As shown in FIGS. 23 and 24, the power element 9 of the capsule comprises an upper housing 10, a lower housing 11, a diaphragm 12, a partition 35, and a disk 13. Activated carbon 36 for adjusting the temperature characteristics of the expansion valve 1 is placed in a chamber enclosed by the upper housing 10 and the partition 35.

The valve portion of the capsule has a body 32 an upper end of which is screwed into the lower housing 11, and the body 32 has a shaft 15 axially movably held therein. The upper end of the shaft 15 is supported by the holder 18 disposed on the upper end of the body 32. The holder 18 is urged by a spring 37 such that it is brought into abutment with the disk 13. A ball-shaped valve element 4 urged by a compression coil spring 6 via a valve element receiver 5 is brought into abutment with the lower end face of the shaft 15. Load of the compression coil spring 6 is adjusted by an adjustment screw 8 screwed into the valve casing 30, whereby the set point of the expansion valve 1 is adjusted.

The expansion valve 1 is assembled by mounting the capsule configured as above into the valve casing 30. The capsule is mounted in the valve casing 30 by inserting the capsule into the valve casing 30 from above, and closing the upper opening of the valve casing 30 with a lid 38, and fixing the lid 38 by a stop ring 39, such as a C ring. It should be noted that the operation of the expansion valve 1 configured as above is the same as the operations of the expansion valves 1 according to the first to seventh embodiments, and hence detailed description thereof is omitted.

The expansion valve according to the present invention can reduce untoward noise and noise of the flow of refrigerant, and therefore provides advantageous effects in that it does not cause occupant discomfort.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A method of forming a low pressure passage in an expansion valve, comprising:

drilling a first hole in a first side surface of the prismatic body, the first hole being drilled along an axis of a first port opening in the first side surface of the prismatic body; and drilling a second hole in a second side surface of the prismatic body adjacent the first side surface, the second hole being drilled along an axis of a second port opening in the second side surface of the prismatic body, wherein the first and second holes form the low pressure passage such that the low pressure passage is bent at a right angle in the prismatic body, and a tip of a first drill used to drill the first hole is not inserted beyond the second hole drilled by a second drill.

2. The method as recited in claim 1, further comprising:

forming a third hole along an axis orthogonal to the axes of the first and second ports, respectively, the third hole having a diameter at least equal to a diameter of the first and second holes forming the low-pressure passage, and at an intersecting portion of the low-pressure passage.

3. The method as recited in claim 1, wherein the low-pressure passage is formed by drilling the first and second holes, using respective drills, in a manner such that the tip of the first drill coincides with an inner wall on an outer peripheral side of the second hole drilled by the second drill.

4. The method as recited in claim 1, wherein the low-pressure passage is formed by drilling the first and second holes, using the respective drills, in a manner such that the tip of the first drill coincides with an inner wall on an outer peripheral side of the second hole drilled by the second drill, and an inclined surface of a cutting edge angle of the first drill coincides with an inclined surface of a cutting edge angle of the second drill.

5. The method as recited in claim 1, further comprising:

cutting off an edge line as a juncture of the first and second holes formed by drilling, with a tool inserted into the first and second holes.

6. An expansion valve, comprising:

a prismatic body;

a first port opening in a first side surface of the prismatic body;

a first hole formed coaxially with an axis of the first port opening in a first side surface of the prismatic body;

a second port opening in the second side surface of the prismatic body, adjacent the first side surface;

a second hole formed coaxially with an axis of the second port opening in the second side surface of the prismatic body; and a third hole formed along an axis orthogonal to the axes of the first and second ports, respectively, the third hole having a diameter at least equal to a diameter of the first and second holes forming the low-pressure passage, and at an intersecting portion of the low-pressure passage;

wherein the first and second holes form a low pressure passage such that the low pressure passage is bent at a right angle in the prismatic body.

7. An expansion valve, comprising:

a prismatic body;

a first port opening in a first side surface of the prismatic body;

a first hole formed coaxially with an axis of the first port opening in a first side surface of the prismatic body; and a second port opening in the second side surface of the prismatic body, adjacent the first side surface; and a second hole formed coaxially with an axis of the second port opening in the second side surface of the prismatic body, wherein the first and second holes form a low pressure passage such that the low pressure passage is bent at a right angle in the prismatic body, and wherein an intersecting portion of the first and second holes forming the low-pressure passage has an outer peripheral portion that forms a radius of curvature.

8. The expansion valve as recited in claim 7, wherein an intersecting portion of the first and second holes is chamfered.

9. An expansion valve, comprising:

a prismatic body;

a first port opening in a first side surface of the prismatic body;

a first hole formed coaxially with an axis of the first port opening in a first side surface of the prismatic body; and a second port opening in the second side surface of the prismatic body, adjacent the first side surface; and a second hole formed coaxially with an axis of the second port opening in the second side surface of the prismatic body, wherein the first and second holes form a low pressure passage such that the low pressure passage is bent at a right angle in the prismatic body, and wherein an intersecting portion of the first and second holes forming the low-pressure passage has an outer peripheral portion having an inclined surface.

10. The expansion valve as recited in claim 9, wherein an intersecting portion of the first and second holes is chamfered.

* * * * *